US009552791B2

(12) United States Patent
Bae et al.

(10) Patent No.: US 9,552,791 B2
(45) Date of Patent: Jan. 24, 2017

(54) DISPLAY DRIVING CIRCUIT AND A DISPLAY DEVICE HAVING THE SAME

(71) Applicant: SAMSUNG ELECTRONICS CO., LTD., Suwon-si, Gyeonggi-do (KR)

(72) Inventors: Jong-Kon Bae, Seoul (KR); Won-Sik Kang, Seoul (KR); Yang-Hyo Kim, Suwon-si (KR); Jae-Hyuck Woo, Osan-si (KR)

(73) Assignee: SAMSUNG ELECTRONICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 14/550,312

(22) Filed: Nov. 21, 2014

(65) Prior Publication Data

US 2015/0262543 A1 Sep. 17, 2015

(30) Foreign Application Priority Data

Mar. 11, 2014 (KR) ..... 10-2014-0028287

(51) Int. Cl.
*G09G 5/00* (2006.01)
*G09G 3/20* (2006.01)

(52) U.S. Cl.
CPC ..... *G09G 5/001* (2013.01); *G09G 3/20* (2013.01); *G09G 5/006* (2013.01); *G09G 2310/08* (2013.01); *G09G 2330/021* (2013.01); *G09G 2330/023* (2013.01); *G09G 2330/06* (2013.01); *G09G 2370/08* (2013.01)

(58) Field of Classification Search
CPC .... G09G 5/001; G09G 5/006; G09G 2370/08; G09G 2330/06; G09G 2330/023; G09G 2310/08;G09G 2310/027; G09G 2310/0272; G09G 2310/0278; G09G 2310/0286; G09G 2310/0291; G09G 2310/0294; G09G 3/3685; G09G 3/3688; G09G 3/3692; G09G 3/3696; G09G 2330/021; G09G 3/20
USPC ..... 345/213
See application file for complete search history.

(56) References Cited

U.S. PATENT DOCUMENTS

| | | | | |
|---|---|---|---|---|
| 6,980,191 | B2 | 12/2005 | Nakamura et al. | |
| 7,659,900 | B2 | 2/2010 | MacInnis et al. | |
| 7,826,535 | B2 | 11/2010 | Alvarez | |
| 7,940,242 | B2 | 5/2011 | Lin | |
| 2003/0006955 | A1 * | 1/2003 | Tsuchi | G09G 3/3688 345/92 |

(Continued)

*Primary Examiner* — Tom Sheng
(74) *Attorney, Agent, or Firm* — F. Chau & Associates, LLC

(57) ABSTRACT

A display driving circuit includes first through (2*n)-th buffers, a buffer controller, first through n-th image processing units, and a source driver. The buffer controller circularly selects one of the first through (2*n)-th buffers in an order from the first buffer to the (2*n)-th buffer at each of a plurality of first time intervals, and stores pixel data received during the first time interval in the selected buffer. Each of the first through n-th image processing units is coupled to two corresponding buffers among the first through (2*n)-th buffers, and processes the pixel data, which are stored in at least one of their corresponding buffers, during n of the first time intervals to generate processed data when the pixel data are stored in the corresponding buffer during the first time interval. The source driver generates analog signals based on the processed data.

20 Claims, 14 Drawing Sheets

(56) References Cited

U.S. PATENT DOCUMENTS

| | | | | |
|---|---|---|---|---|
| 2003/0067434 | A1* | 4/2003 | Haga | G09G 3/3648 345/98 |
| 2006/0232678 | A1* | 10/2006 | Choi | G09G 3/3233 348/207.11 |
| 2007/0176881 | A1* | 8/2007 | Lin | G09G 3/3685 345/100 |
| 2007/0279361 | A1 | 12/2007 | Shin | |
| 2008/0001898 | A1 | 1/2008 | Chang | |
| 2008/0049257 | A1 | 2/2008 | Jeong et al. | |
| 2009/0244080 | A1 | 10/2009 | Ishikura | |
| 2010/0177069 | A1* | 7/2010 | Park | G09G 3/3685 345/204 |
| 2012/0054479 | A1 | 3/2012 | Park | |

* cited by examiner

DISPLAY DRIVING CIRCUIT AND A DISPLAY DEVICE HAVING THE SAME

CROSS-REFERENCE TO RELATED APPLICATION(S)

This application claims priority under 35 U.S.C. §119 to Korean Patent Application No. 10-2014-0028287, filed on Mar. 11, 2014 in the Korean Intellectual Property Office (KIPO), the disclosure of which is incorporated by reference herein in its entirety.

TECHNICAL FIELD

Example embodiments of the inventive concept relate to a display device, and more particularly to a display driving circuit and a display device including the display driving circuit.

DESCRIPTION OF THE RELATED ART

In general, as a resolution of a display device increases, a speed of transmitting image signals from a processor to a display driving circuit of the display device increases. To display high speed image signals, the display driving circuit operates in synchronization with an internal clock signal having a high frequency.

However, when a frequency of the internal clock signal used by the display driving circuit increases, harmonics may be generated by the internal clock signal and a clock signal having a high frequency that is used in transmitting the image signals from the processor to the display driving circuit. Therefore, electromagnetic interference (EMI) may result and power consumption of the display device may increase.

SUMMARY

An exemplary embodiment of the inventive concept provides a display driving circuit that operates in synchronization with an internal clock signal having a relatively low frequency.

An exemplary embodiment of the inventive concept provides a display device including the display driving circuit.

According to an exemplary embodiment of the inventive concept, a display driving circuit includes first through (2*n)-th buffers, a buffer controller, first through n-th image processing units, and a source driver. The buffer controller circularly selects one of the first through (2*n)-th buffers in an order from the first buffer to the (2*n)-th buffer at each of a plurality of first time intervals, and stores pixel data received during the first time interval in the selected buffer. Each of the first through n-th image processing units is coupled to two corresponding buffers among the first through (2*n)-th buffers, and each of the first through n-th image processing units processes the pixel data, which are stored in at least one of their corresponding buffers, during n of the first time intervals to generate processed data when the pixel data are stored in the corresponding buffer during the first time interval. The source driver generates analog signals based on the processed data received from the first through n-th image processing units.

In an exemplary embodiment of the inventive concept, a k-th image processing unit may be coupled to a k-th buffer and an (n+k)-th buffer, where k is a positive integer equal to or smaller than n.

In an exemplary embodiment of the inventive concept, each of the first through n-th image processing units may delay at least a part of the processed data, which are generated during n of the first time intervals, and then provide the delayed processed data to the source driver.

In an exemplary embodiment of the inventive concept, the display driving circuit may further include an oscillator configured to generate a first internal clock signal having a first frequency and a second internal clock signal having a second frequency. The first frequency may be smaller than 1/(2*n) of a frequency in which the pixel data are provided to the buffer controller, and the second frequency may correspond to a half of the first frequency. Each of the first through n-th image processing units may operate in synchronization with the first internal clock signal. The source driver may operate in synchronization with the second internal clock signal.

Each of the first through n-th image processing units may read the pixel data from the corresponding buffer in a unit of two pixels in synchronization with the first internal clock signal, process the read pixel data, and generate the processed data in a unit of two pixels.

In an exemplary embodiment of the inventive concept, the display driving circuit may further include a serial communication unit configured to receive image signals corresponding to one row of a display panel from an external device through a serial interface during a horizontal period, which corresponds to a period of a horizontal synchronization signal, and generate the pixel data corresponding to the one row during the horizontal period.

The serial interface may include a mobile industry processor interface (MIPI).

In an exemplary embodiment of the inventive concept, each of the first time intervals may correspond to a horizontal period, which corresponds to a period of a horizontal synchronization signal.

One of the first through n-th image processing units may provide the processed data corresponding to one row of a display panel to the source driver during one of the horizontal periods.

When the pixel data corresponding to one row are stored in at least one of their corresponding buffers during the horizontal periods, each of the first through n-th image processing units may temporarily store the processed data generated during first through (n−1)-th horizontal periods, and provide the processed data generated during an n-th horizontal period together with the processed data temporarily stored during the first through (n−1)-th horizontal periods to the source driver during the n-th horizontal period.

Each of the first through n-th image processing units may include first through (n−1)-th sub buffers having a size corresponding to 1/n of a size of each of the first through (2*n)-th buffers, an image processing circuit configured to process 1/n of the pixel data stored in at least one of their corresponding buffers to generate the processed data corresponding to 1/n of a row of a display panel during each horizontal period from a first horizontal period to an n-th horizontal period, and a delay controller configured to store the processed data generated by the image processing circuit during each horizontal period from the first horizontal period to an (n−1)-th horizontal period in the first through (n−1)-th sub buffers as first through (n−1)-th sub line data, respectively, and output n-th sub line data, which correspond to the processed data generated by the image processing circuit during the n-th horizontal period, together with the first through (n−1)-th sub line data stored in the first through (n−1)-th sub buffers during the n-th horizontal period.

The source driver may include first through n-th shift registers configured to receive the first through n-th sub line data, respectively, from one of the first through n-th image processing units during one of the horizontal periods, and configured to output parallel data corresponding to the 1/n of a row by parallelizing the processed data corresponding to the 1/n of a row included in the first through n-th sub line data, respectively, during the horizontal period, first through n-th latch units configured to latch the parallel data corresponding to the 1/n of a row output from the first through n-th shift registers, respectively, and first through n-th conversion units configured to generate the analog signals corresponding to the 1/n of a row based on output signals of the first through n-th latch units, respectively.

Each of the first through n-th shift registers may perform a shift operation on the processed data in a unit of four pixels to generate the parallel data.

In an exemplary embodiment of the inventive concept, the first time interval may correspond to 1/m of a horizontal period, which corresponds to a period of a horizontal synchronization signal, where m is an integer equal to or greater than two.

According to an exemplary embodiment of the inventive concept, a display device includes a display panel and a display driving circuit. The display panel includes a plurality of pixels coupled to a plurality of gate lines and a plurality of data lines. The display driving circuit selects one of the plurality of gate lines at each of a plurality of horizontal periods, and provides analog signals to the pixels coupled to the selected gate line through the plurality of data lines during the horizontal period. The display driving circuit buffers pixel data received during a first time interval, which is equal to or smaller than the horizontal period, and processes the buffered pixel data to generate the analog signals during n of the first time intervals.

In an exemplary embodiment of the inventive concept, the display driving circuit may include first through (2*n)-th buffers, a buffer controller, first through n-th image processing units, and a source driver. The buffer controller circularly selects one of the first through (2*n)-th buffers in an order from the first buffer to the (2*n)-th buffer at each of a plurality of the first time intervals, and stores the pixel data received during the first time interval in the selected buffer. Each of first through n-th image processing units is coupled to two corresponding buffers among the first through (2*n)-th buffers, and processes the pixel data, which are stored in at least one of their corresponding buffers, during n of the first time intervals to generate processed data when the pixel data are stored in the corresponding buffer during the first time interval. The source driver generates the analog signals based on the processed data received from the first through n-th image processing units.

According to an exemplary embodiment of the inventive concept, a display driving circuit includes a first buffer configured to receive and store pixel data corresponding to a first row of a display panel in a first horizontal period; a first image processing circuit configured to read the pixel data stored in the first buffer in a second horizontal period and a third horizontal period, and perform a signal processing on the read pixel data to generate first processed data; a first delay controller configured to store the first processed data, which corresponds to a half of the first row, in the second horizontal period in a first sub buffer, provide the processed data stored in the first sub buffer to a first shift register in the third horizontal period, and provide the first processed data to a second shift register in the third horizontal period; a second buffer configured to receive and store pixel data corresponding to a second row of the display panel in the second horizontal period; a second image processing circuit configured to read the pixel data stored in the second buffer in the third horizontal period and a fourth horizontal period, and perform a signal processing on the read pixel data to generate second processed data; and a second delay controller configured to store the second processed data, which corresponds to a half of the second row, in the third horizontal period in a second sub buffer, provide the processed data stored in the second sub buffer to the first shift register in the fourth horizontal period, and provide the second processed data to the second shift register in the fourth horizontal period.

The first and second buffers operate in response to a first internal clock and the first and second shift registers operate in response to a second internal clock.

A frequency of the first internal clock is greater than a frequency of the second internal clock.

The first and second pixel data are provided to the display driving circuit at a frequency greater than the frequency of the first internal clock.

BRIEF DESCRIPTION OF THE DRAWINGS

The above and other features of the inventive concept will become more apparent by describing in detail exemplary embodiments thereof with reference to the accompanying drawings.

DETAILED DESCRIPTION OF THE EMBODIMENTS

Figure 1:
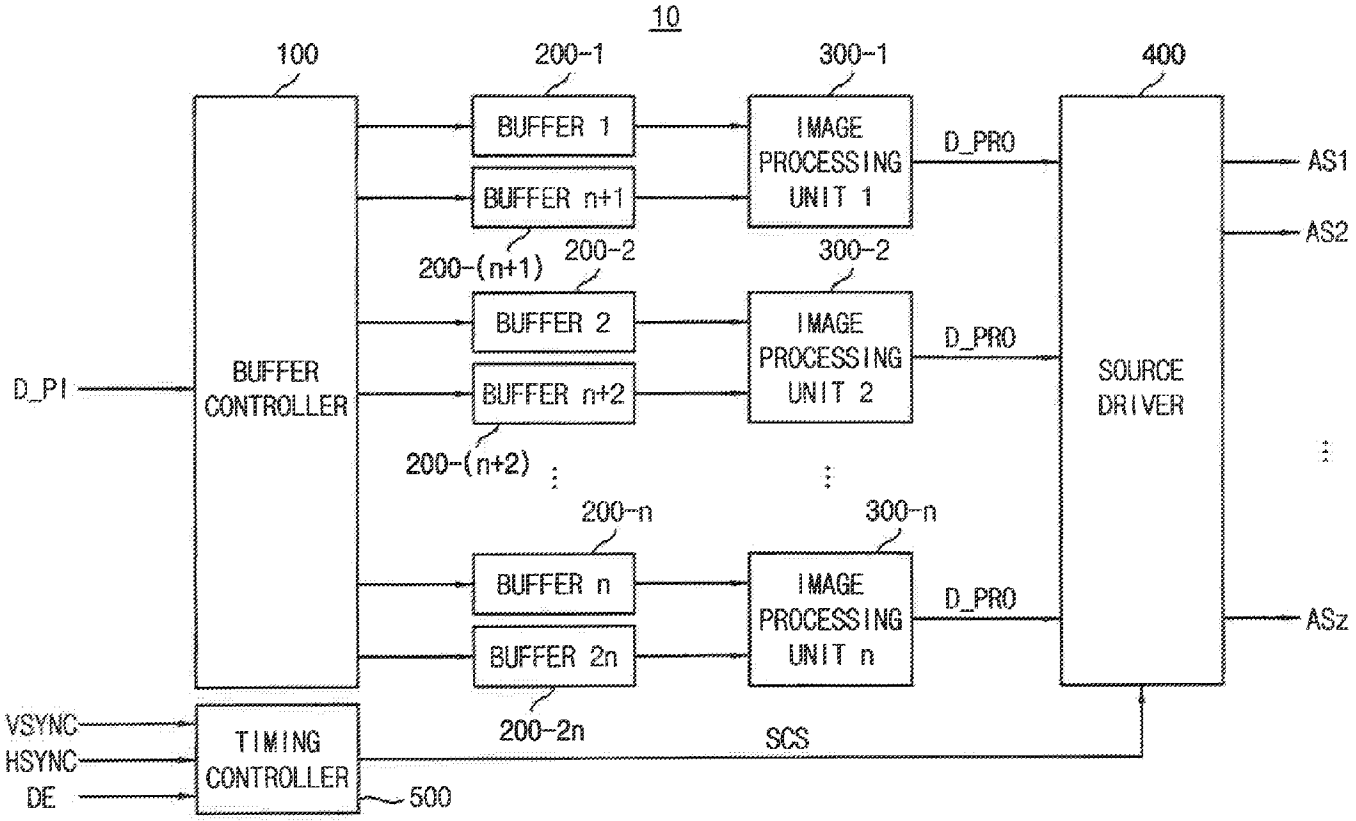
FIG. 1 is a block diagram illustrating a display driving circuit according to an exemplary embodiment of the inventive concept.

Exemplary embodiments of the inventive concept will be described more fully with hereinafter with reference to the accompanying drawings. The present inventive concept may, however, be embodied in many different forms and should not be construed as limited to the embodiments set forth herein. Like reference numerals may refer to like elements throughout this application.

It will be understood that when an element is referred to as being "connected" or "coupled" to another element, it can be directly connected or coupled to the other element or intervening elements may be present.

As used herein, the singular forms "a," "an" and "the" are intended to include the plural forms as well, unless the context clearly indicates otherwise.

FIG. 1 is a block diagram illustrating a display driving circuit according to an exemplary embodiment of the inventive concept.

Referring to FIG. 1, a display driving circuit 10 includes a buffer controller 100, first through (2*n)-th buffers 200-1~200-2*n*, first through n-th image processing units 300-1~300-*n*, and a source driver 400. Here, n represents an integer equal to or greater than two.

The buffer controller 100 receives a plurality of pixel data D_PI. The buffer controller 100 circularly selects one of the first through (2*n)-th buffers 200-1~200-2*n* in an order from the first buffer 200-1 to the (2*n)-th buffer 200-2*n* at every first time interval, and stores the pixel data D_PI received during the first time interval in the selected buffer.

For example, after the buffer controller 100 stores the pixel data D_PI received during the first time interval in the first buffer 200-1, the buffer controller 100 may store the pixel data D_PI received during the first time interval that comes next in the second buffer 200-2. In addition, after the buffer controller 100 stores the pixel data D_PI received during the first time interval in the (2*n)-th buffer 200-2*n*, the buffer controller 100 may store the pixel data D_PI received during the first time interval that comes next in the first buffer 200-1.

A size of each of the first through (2*n)-th buffers 200-1~200-2*n* may correspond to a size of the pixel data D_PI received during the first time interval.

Each of the first through n-th image processing units 300-1~300-*n* are coupled to two corresponding buffers among the first through (2*n)-th buffers 200-1~200-2*n*. For example, with reference to FIG. 1, a k-th image processing unit 300-*k* may be coupled to a k-th buffer 200-*k* and an (n+k)-th buffer 200-(*n*+k). Here, k represents a positive integer equal to or smaller than n.

When the pixel data D_PI are stored in the corresponding buffers during the first time interval, each of the first through n-th image processing units 300-1~300-*n* processes the pixel data D_PI, which are stored in their corresponding buffer, during n times of the first time interval to generate processed data D_PRO.

For example, when the pixel data D_PI are stored in one of the k-th buffer 200-*k* and the (n+k)-th buffer 200-(*n*+k) during the first time interval, the k-th image processing unit 300-*k* may successively read the pixel data D_PI from the one of the k-th buffer 200-*k* and the (n+k)-th buffer 200-(*n*+k) during n times of the first time interval and perform a signal processing on the read pixel data D_PI to generate the processed data D_PRO.

The source driver 400 generates analog signals AS1~ASz based on the processed data D_PRO received from the first through n-th image processing units 300-1~300-*n*. Here, z represents a positive integer equal to or greater than two. As will be described later, the analog signals AS1~ASz may be provided to pixels in a row included in a display panel through data lines.

In an exemplary embodiment of the inventive concept, the display driving circuit 10 may further include a timing controller 500.

The timing controller 500 may receive a vertical synchronization signal VSYNC, a horizontal synchronization signal HSYNC and a data enable signal DE. The timing controller 500 may generate a source control signal SCS to control the source driver 400 based on the vertical synchronization signal VSYNC, the horizontal synchronization signal HSYNC and the data enable signal DE. For example, the source control signal SCS may include a source output enable signal used to control an output of the analog signals AS1~ASz.

In an exemplary embodiment of the inventive concept, the first time interval may be equal to or smaller than a horizontal period, which corresponds to a period of the horizontal synchronization signal HSYNC. Therefore, the size of each of the first through (2*n)-th buffers 200-1~200-2*n* may be equal to or smaller than a total size of the pixel data D_PI corresponding to one row.

In an exemplary embodiment of the inventive concept, to control a display timing, each of the first through n-th image processing units 300-1~300-*n* may delay at least a part of the processed data D_PRO, which are generated during n times of the first time interval, and then provide the delayed processed data to the source driver 400.

As described above, each of the first through n-th image processing units 300-1~300-*n* may process the pixel data D_PI, which are received during the first time interval, during n times of the first time interval to generate the processed data D_PRO. However, the first through n-th image processing units 300-1~300-*n* may process the pixel data D_PI stored in respective buffers simultaneously to provide the processed data D_PRO. Therefore, a total amount of the pixel data D_PI processed by the first through n-th image processing units 300-1~300-*n* during the first time interval may be the same as the total amount of the pixel data D_PI received by the buffer controller 100 during the first time interval.

Figure 2:
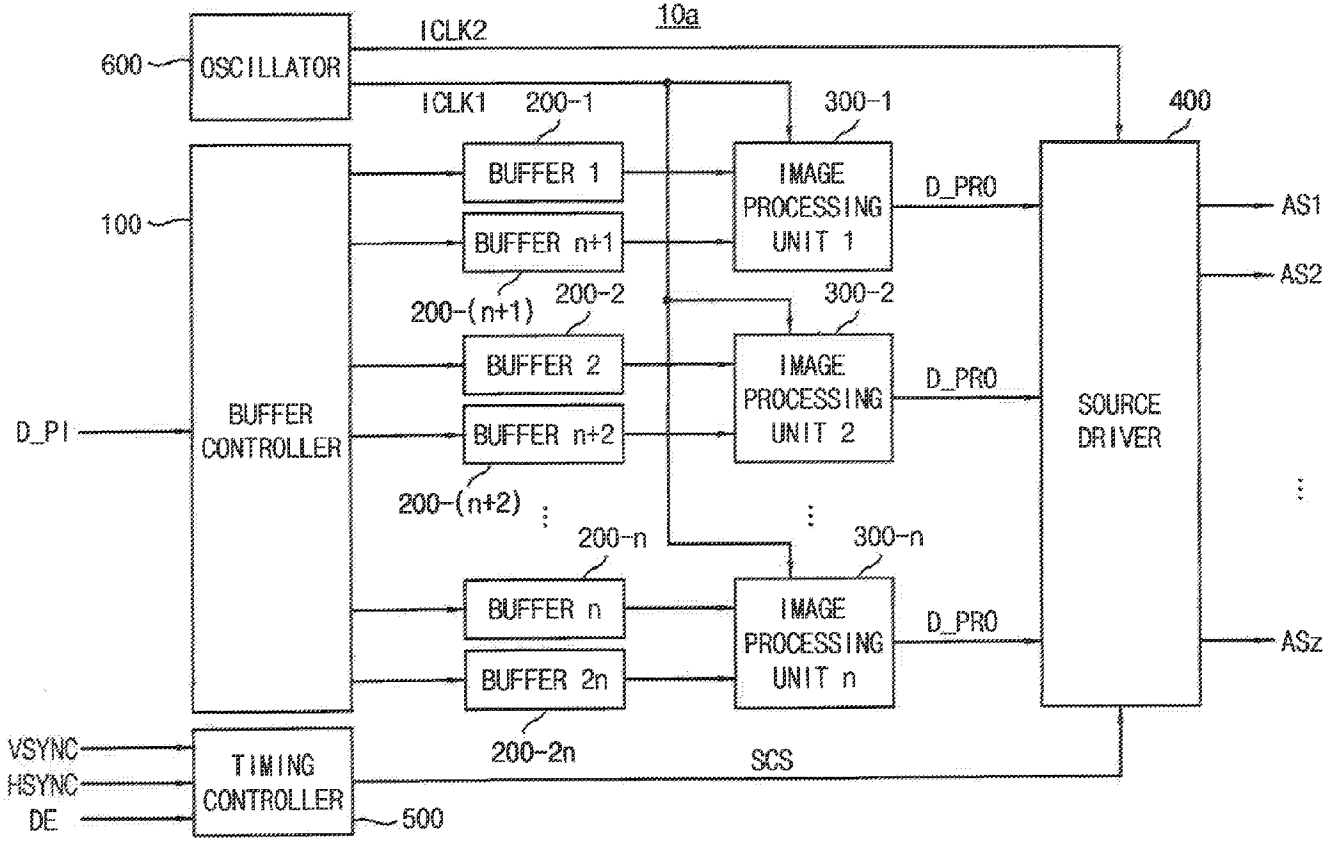
FIG. 2 is a block diagram illustrating a display driving circuit according to an exemplary embodiment of the inventive concept.

FIG. 2 is a block diagram illustrating a display driving circuit according to an exemplary embodiment of the inventive concept.

Referring to FIG. 2, a display driving circuit 10*a* may include the buffer controller 100, the first through (2*n)-th buffers 200-1~200-2*n*, the first through n-th image processing units 300-1~300-*n*, the source driver 400, the timing controller 500 and an oscillator 600.

The display driving circuit 10*a* of FIG. 2 may be the same as the display driving circuit 10 of FIG. 1 except that the display driving circuit 10*a* of FIG. 2 further includes the oscillator 600.

The oscillator 600 may generate a first internal clock signal ICLK1 having a first frequency and a second internal clock signal ICLK2 having a second frequency. The first frequency may be smaller than 1/(2*n) times of a frequency in which the pixel data D_PI are provided to the buffer controller 100. The second frequency may correspond to a half of the first frequency. The oscillator 600 may provide the first internal clock signal ICLK1 to each of the first through n-th image processing units 300-1~300-*n*, and provide the second internal clock signal ICLK2 to the source driver 400.

Each of the first through n-th image processing units 300-1~300-*n* may operate in synchronization with the first internal clock signal ICLK1. For example, each of the first through n-th image processing units 300-1~300-*n* may read the pixel data D_PI from their corresponding buffer in a unit of two pixels in synchronization with the first internal clock signal ICLK1, process the read pixel data D_PI, and generate the processed data D_PRO in a unit of two pixels.

Since each of the first through n-th image processing units 300-1~300-*n* processes the pixel data D_PI, which are received during the first time interval, by reading the pixel data D_PI in a unit of two pixels during n times of the first time interval, a frequency in which each of the first through n-th image processing units 300-1~300-*n* reads the pixel data D_PI from their corresponding buffer may correspond to 1/(2*n) times of a frequency in which the pixel data D_PI are provided to the buffer controller 100.

In addition, since there is a blank period, in which the pixel data D_PI are not provided, the buffer controller 100 may not receive the pixel data D_PI continuously. The blank period may occur between the horizontal periods. Therefore, each of the first through n-th image processing units 300-1~300-*n* may read the pixel data D_PI from their corresponding buffer in synchronization with the first internal clock signal ICLK1 having the first frequency, which is smaller than 1/(2*n) times of the frequency in which the pixel data D_PI are provided to the buffer controller 100, and process the read pixel data D_PI to generate the processed data D_PRO.

Since each of the first through n-th image processing units 300-1~300-*n* reads the pixel data D_PI stored in their corresponding buffer in a unit of two pixels and processes the read pixel data D_PI to generate the processed data D_PRO in a unit of two pixels, the source driver 400 may generate the analog signals AS1~ASz by performing a shift operation on the processed data D_PRO in a unit of four pixels in synchronization with the second internal clock signal ICLK2 having the second frequency, which is a half of the first frequency.

Figure 3:
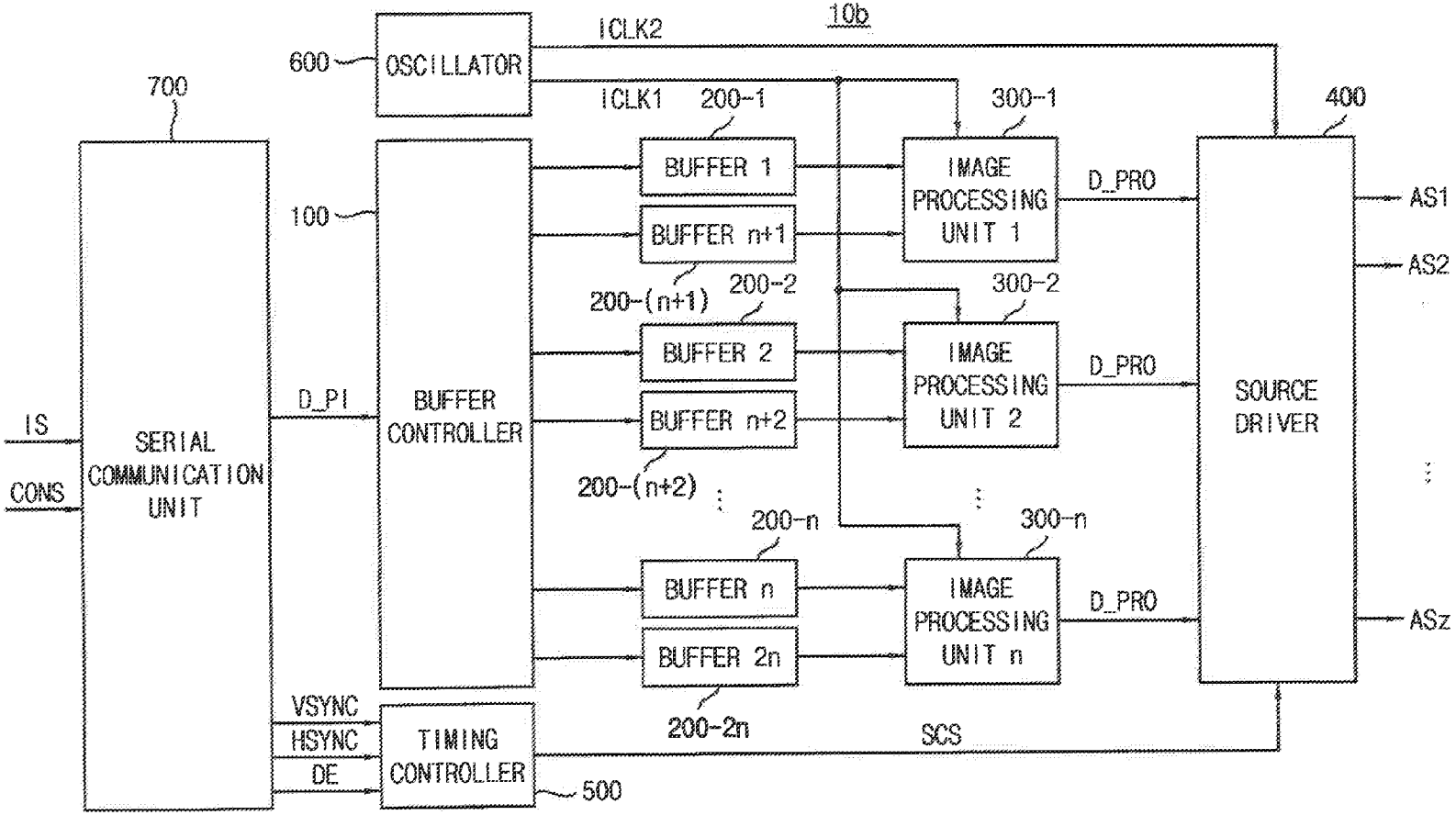
FIG. 3 is a block diagram illustrating a display driving circuit according to an exemplary embodiment of the inventive concept.

FIG. 3 is a block diagram illustrating a display driving circuit according to an exemplary embodiment of the inventive concept.

Referring to FIG. 3, a display driving circuit 10*b* may include the buffer controller 100, the first through (2*n)-th buffers 200-1~200-2*n*, the first through n-th image processing units 300-1~300-*n*, the source driver 400, the timing controller 500, the oscillator 600 and a serial communication unit 700.

The display driving circuit 10*b* of FIG. 3 may be the same as the display driving circuit 10*a* of FIG. 2 except that the display driving circuit 10*b* of FIG. 3 further includes the serial communication unit 700.

The serial communication unit 700 may receive image signals IS and control signals CONS from an external device through a serial interface. For example, the serial communication unit 700 may receive the image signals IS corresponding to one row from the external device through the serial interface during the horizontal period, which corresponds to a period of the horizontal synchronization signal HSYNC, and generate the pixel data D_PI corresponding to one row during the horizontal period. Therefore, the buffer controller 100 may receive the pixel data D_PI corresponding to one row from the serial communication unit 700 during the horizontal period. In addition, the serial communication unit 700 may generate the vertical synchronization signal VSYNC, the horizontal synchronization signal HSYNC and the data enable signal DE based on the control signals CONS, and provide the vertical synchronization signal VSYNC, the horizontal synchronization signal HSYNC and the data enable signal DE to the timing controller 500.

In an exemplary embodiment of the inventive concept, the serial interface may correspond to a mobile industry processor interface (MIPI).

Figure 4:
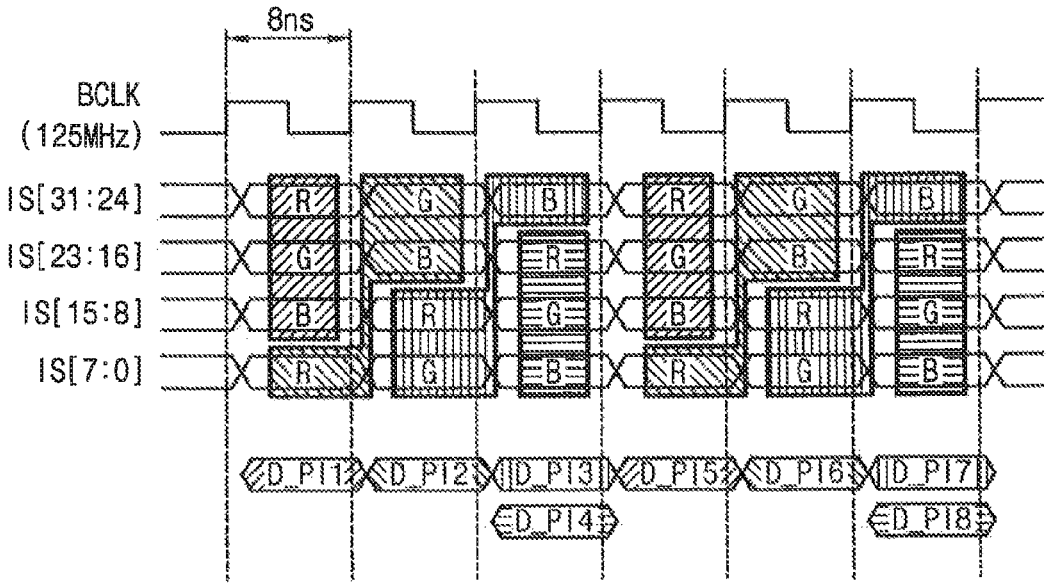
FIG. 4 is a timing diagram illustrating image signals provided to a serial communication unit included in a display driving circuit of FIG. 3, according to an exemplary embodiment of the inventive concept.

FIG. 4 is a timing diagram illustrating image signals provided to a serial communication unit included in a display driving circuit of FIG. 3, according to an exemplary embodiment of the inventive concept.

In FIG. 4, the image signals IS are provided to the serial communication unit 700 at a frequency of 1 GHz through a 4-lane MIPI.

Referring to FIG. 4, since one bit signal is transmitted at a frequency of 1 GHz through each of the four lanes, the image signal IS having 32 bits may be provided to the serial communication unit 700 in synchronization with a byte clock signal BCLK having a frequency of 125 MHz.

As illustrated in FIG. 4, one pixel data D_PI may include 8 bits of red data R, 8 bits of green data G and 8 bits of blue data B. Therefore, first pixel data D_PI1 may be received during a first period of the byte clock signal BCLK, second pixel data D_PI2 may be received during a second period of the byte clock signal BCLK, and third pixel data D_PI3 and fourth pixel data D_PI4 may be received during a third period of the byte clock signal BCLK. Fifth pixel data D_PI5 may be received during a fourth period of the byte clock signal BCLK, sixth pixel data D_PI6 may be received during a fifth period of the byte clock signal BCLK, and seventh pixel data D_PI7 and eighth pixel data D_PI8 may be received during a sixth period of the byte clock signal BCLK.

As illustrated in FIG. 4, since four pixel data D_PI are provided to the buffer controller 100 every 24 ns, an average frequency in which the pixel data D_PI are provided to the buffer controller 100 may be about 167 MHz.

As described above with reference to FIG. 3, the first frequency of the first internal clock signal ICLK1 may be smaller than 1/(2*n) times of a frequency in which the pixel data D_PI are provided to the buffer controller 100. Therefore, when n is two, the first frequency may be smaller than about 41.75 MHz.

As described above, in the display driving circuit 10 according to an exemplary embodiment of the inventive concept, although the pixel data D_PI are provided to the display driving circuit 10 at a relatively high frequency, each of the first through n-th image processing units 300-1~300-*n* may operate in synchronization with the first internal clock signal ICLK1 having the first frequency, which is a relatively low frequency, and the source driver 400 may operate in synchronization with the second internal clock signal ICLK2 having the second frequency, which is a half of the first frequency. Therefore, the display driving circuit 10 may prevent electromagnetic interference (EMI) and decrease power consumption.

In an exemplary embodiment of the inventive concept, the first time interval may be equal to the horizontal period, which corresponds to a period of the horizontal synchronization signal HSYNC.

In this case, the size of each of the first through (2*n)-th buffers 200-1~200-2*n* may be equal to a total size of the pixel data D_PI corresponding to one row received during the horizontal period. In other words, each of the first through (2*n)-th buffers 200-1~200-2*n* may be a line buffer for storing the pixel data D_PI corresponding to one row.

Hereinafter, the first time interval will be described to be equal to the horizontal period, which corresponds to a period of the horizontal synchronization signal HSYNC.

Figure 5:
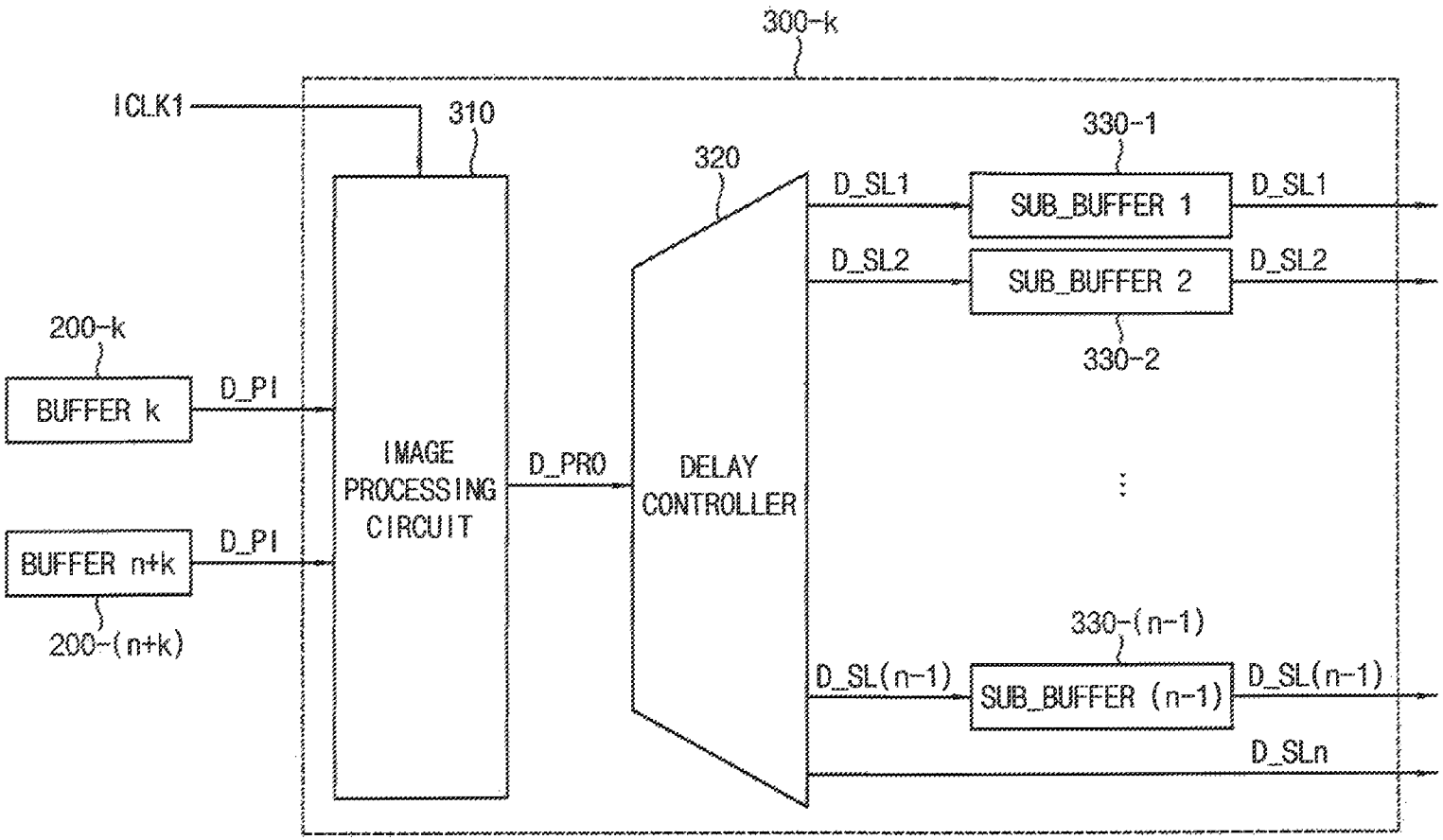
FIG. 5 is a block diagram illustrating an exemplary embodiment of an image processing unit included in the display driving circuit of FIG. 1.

FIG. 5 is a block diagram illustrating an exemplary embodiment of an image processing unit included in the display driving circuit 10 of FIG. 1.

Referring to FIG. 5, a k-th image processing unit 300-*k* may be coupled to a k-th buffer 200-*k* and an (n+k)-th buffer 200-(*n*+k).

When the pixel data D_PI corresponding to one row are stored in a corresponding buffer, in other words, one of the k-th buffer 200-*k* and the (n+k)-th buffer 200-(*n*+k) during the horizontal period, the k-th image processing unit 300-*k* may process the pixel data D_PI, which are stored in the corresponding buffer, during next first through n-th horizontal periods to generate the processed data D_PRO. In this case, the k-th image processing unit 300-*k* may temporarily store the processed data D_PRO generated during the first through (n−1)-th horizontal periods, and provide the processed data D_PRO generated during the n-th horizontal period together with the processed data D_PRO temporarily stored during the first through (n−1)-th horizontal periods to the source driver 400 during the n-th horizontal period.

Referring to FIG. 5, the k-th image processing unit 300-*k* may include an image processing circuit 310, a delay controller 320 and first through (n−1)-th sub buffers 330-1~330-(*n*−1).

When the pixel data D_PI corresponding to one row are stored in a corresponding buffer, in other words, one of the k-th buffer 200-*k* and the (n+k)-th buffer 200-(*n*+k) during the horizontal period, the image processing circuit 310 may read 1/n of the pixel data D_PI stored in the corresponding buffer in synchronization with the first internal clock signal ICLK1 during each horizontal period from the first horizontal period to the n-th horizontal period, and process the read pixel data D_PI to generate the processed data D_PRO. Therefore, the image processing circuit 310 may generate the processed data D_PRO corresponding to 1/n row during each horizontal period from the first horizontal period to the n-th horizontal period.

Each of the first through (n−1)-th sub buffers 330-1~330-(*n*−1) may have a size corresponding to 1/n times of a size of each of the first through (2*n)-th buffers 200-1~200-2*n*. Since each of the first through (2*n)-th buffers 200-1~200-2*n* is a line buffer for storing the pixel data D_PI corresponding to one row, each of the first through (n−1)-th sub buffers 330-1~330-(*n*−1) may store the processed data D_PRO corresponding to 1/n row.

The delay controller 320 may store the processed data D_PRO corresponding to 1/n row generated by the image processing circuit 310 during each horizontal period from the first horizontal period to the (n−1)-th horizontal period in the first through (n−1)-th sub buffers 330-1~330-(*n*−1) as first through (n−1)-th sub line data D_SL1~D_SL(n−1), respectively. For example, the delay controller 320 may store the processed data D_PRO corresponding to i/n row generated by the image processing circuit 310 during a p-th horizontal period in a p-th sub buffer 330-*p* as p-th sub line data D_SLp. Here, p represents a positive integer smaller than n.

In addition, the delay controller 320 may provide n-th sub line data D_SLn, which correspond to the processed data D_PRO corresponding to 1/n row generated by the image processing circuit 310 during the n-th horizontal period, together with the first through (n−1)-th sub line data D_SL1~D_SL(n−1) stored in the first through (n−1)-th sub buffers 330-1~330-(*n*−1) to the source driver 400 during the n-th horizontal period. In this case, the n-th sub line data D_SLn is not stored in a sub buffer. Therefore, the delay controller 320 may provide the processed data D_PRO corresponding to one row, which include the first through n-th sub line data D_SL1~D_SLn, to the source driver 400 during the n-th horizontal period using the first through (n−1)-th sub buffers 330-1~330-(*n*−1). A sub-buffer is not used to provide the n-th sub line data D_SLn to the source driver 400.

As described above, the buffer controller 100 may circularly select one of the first through (2*n)-th buffers 200-1~200-2*n* in an order from the first buffer 200-1 to the (2*n)-th buffer 200-2*n* at each horizontal period, and store the pixel data D_PI corresponding to one row in the selected buffer during the horizontal period. After the pixel data D_PI corresponding to one row are stored in the corresponding buffer during the horizontal period, each of the first through n-th image processing units 300-1~300-*n* may provide the processed data D_PRO corresponding to one row to the source driver 400 during the n-th horizontal period. Therefore, one of the first through n-th image processing units 300-1~300-*n* may provide the processed data D_PRO corresponding to one row to the source driver 400 during each horizontal period. For example, one of the first through n-th image processing units 300-1~300-*n* in an order from the first image processing unit 300-1 to the n-th image processing unit 300-*n* may provide the processed data D_PRO corresponding to one row to the source driver 400 during each horizontal period.

Figure 6:
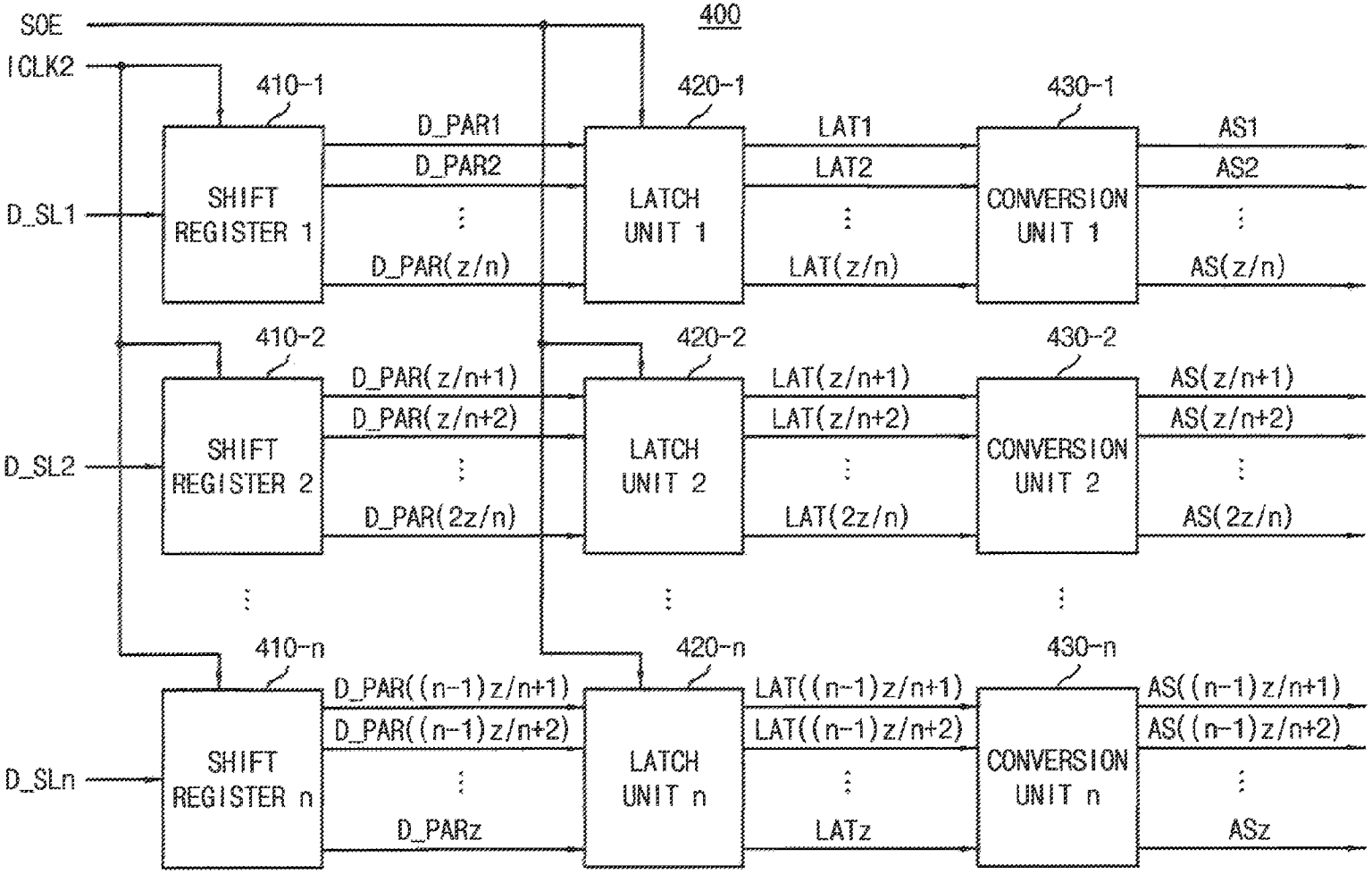
FIG. 6 is a block diagram illustrating an exemplary embodiment of a source driver included in the display driving circuit of FIG. 1.

FIG. 6 is a block diagram illustrating an exemplary embodiment of a source driver included in the display driving circuit 10 of FIG. 1.

Referring to FIG. 6, the source driver 400 may include first through n-th shift registers 410-1~410-*n*, first through n-th latch units 420-1~420-*n*, and first through n-th conversion units 430-1~430-*n*.

The first through n-th shift registers 410-1~410-*n* may receive the first through n-th sub line data D_SL1~D_SLn, respectively, from one of the first through n-th image processing units 300-1~300-*n* during each horizontal period, and output parallel data D_PAR1~D_PARz corresponding to 1/n row by parallelizing the processed data D_PRO corresponding to 1/n row included in the first through n-th sub line data D_SL1~D_SLn, respectively, during the horizontal period.

For example, when the display driving circuit 10 drives first through z-th data lines of a display panel, the first shift register 410-1 may output the parallel data D_PAR1~D_PAR(z/n) corresponding to 1/n row by parallelizing the first sub line data D_SL1, the second shift register 410-2 may output the parallel data D_PAR(z/n+1)~D_PAR(2z/n) corresponding to 1/n row by parallelizing the second sub line data D_SL2, and the n-th shift register 410-*n* may output the parallel data D_PAR((n−1)z/n+1)~D_PARz corresponding to 1/n row by parallelizing the n-th sub line data D_SLn.

In an exemplary embodiment of the inventive concept, the first through n-th shift registers 410-1~410-*n* may generate the parallel data D_PAR1~D_PARz by performing a shift operation on the processed data D_PRO included in the first through n-th sub line data D_SL1~D_SLn in a unit of four pixels in synchronization with the second internal clock signal ICLK2 having the second frequency, which is a half of the first frequency.

The first through n-th latch units 420-1~**420-*n* may latch the parallel data D_PAR1~D_PARz corresponding to 1/n row output from the first through n-th shift registers 410-1~410-*n*, respectively. The first through n-th latch units 420-1~420-*n* may output the latched parallel data D_PAR1~D_PARz as latch signals LAT1~LATz in response to a source output enable signal SOE. The source output enable signal SOE may be provided from the timing controller 500**.

For example, the first latch unit 420-1 may latch the parallel data D_PAR1~D_PAR(z/n) and output the parallel data D_PAR1~D_PAR(z/n) as the latch signals LAT1~LAT(z/n), the second latch unit 420-2 may latch the parallel data D_PAR(z/n+1)~D_PAR(2z/n) and output the parallel data D_PAR(z/n+1)~D_PAR(2z/n) as the latch signals LAT(z/n+1)~LAT(2z/n), and the n-th latch unit **420-*n*** may latch the parallel data D_PAR((n−1)z/n+1)~D_PARz and output the parallel data D_PAR((n−1)z/n+1)~D_PARz as the latch signals LAT((n−1)z/n+1)~LATz.

The first through n-th conversion units 430-1~**430-*n* may perform a digital-to-analog conversion on the latch signals LAT1~LATz output from the first through n-th latch units 420-1~420-*n*** to generate the analog signals AS1~ASz corresponding to 1/n row, respectively.

For example, the first conversion unit 430-1 may perform a digital-to-analog conversion on the latch signals LAT1~LAT(z/n) to generate the analog signals AS1~AS(z/n) corresponding to 1/n row, the second conversion unit 430-2 may perform a digital-to-analog conversion on the latch signals LAT(z/n+1)~LAT(2z/n) to generate the analog signals AS(z/n+1)~AS(2z/n) corresponding to 1/n row, and the n-th conversion unit **430-*n*** may perform a digital-to-analog conversion on the latch signals LAT((n−1)z/n+1)~LATz to generate the analog signals AS((n−1)z/n+1)~ASz corresponding to 1/n row.

Figure 7:
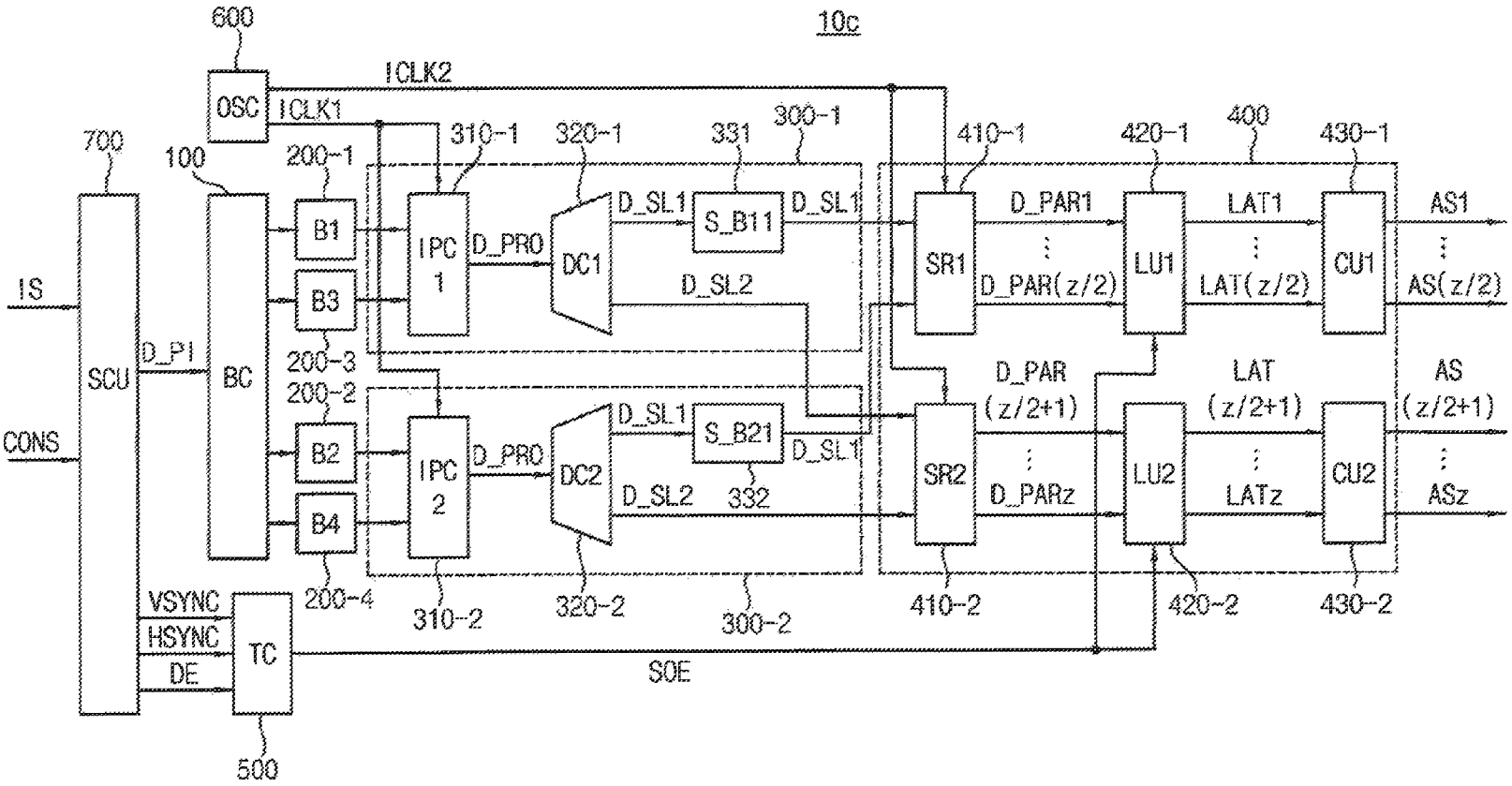
FIG. 7 is a block diagram illustrating a display driving circuit according to an exemplary embodiment of the inventive concept.

FIG. 7 is a block diagram illustrating a display driving circuit according to an exemplary embodiment of the inventive concept.

A display driving circuit **10*c* of FIG. 7 may correspond to the display driving circuit 10*b* of FIG. 3** when n is two.

Referring to FIG. 7, the display driving circuit **10*c* may include the buffer controller BC 100, the first through fourth buffers B1, B2, B3 and B4 200-1, 200-2, 200-3 and 200-4, the first and second image processing units 300-1 and 300-2, the source driver 400, the timing controller TC 500, the oscillator OSC 600 and the serial communication unit SCU 700**.

The first image processing unit 300-1 may include an image processing circuit IPC1 310-1, a delay controller DC1 320-1 and a first sub buffer S_B11 331. The image processing circuit IPC1 310-1 may output the processed data D_PRO, the delay controller DC1 320-1 may output sub line data D_SL1 and D_SL2, and the first sub buffer S_B11 331 may output the sub line data D_SL1.

The second image processing unit 300-2 may include an image processing circuit IPC2 310-2, a delay controller DC2 320-2 and a first sub buffer S_B21 332. The image processing circuit IPC1 310-2 may output the processed data D_PRO, the delay controller DC2 320-2 may output the sub line data D_SL1 and D_SL2, and the first sub buffer S_B21 332 may output the sub line data D_SL1.

The source driver 400 may include first and second shift registers SR1 and SR2 410-1 and 410-2, first and second latch units LU1 and LU2 420-1 and 420-2, and first and second conversion units CU1 and CU2 430-1 and 430-2. The first shift register SR1 410-1 may output parallel data D_PAR1~D_PAR(z/2), the first latch unit LU1 420-1 may output latch signals LAT1~LAT(z/2), and the first conversion unit CU1 430-1 may output analog signals AS1~AS(z/2). The second shift register SR2 410-2 may output parallel data D_PAR(z/2+1)~D_PARz, the second latch unit LU2 420-2 may output latch signals LAT(z/2+1)~LATz, and the second conversion unit CU2 430-2 may output analog signals AS(z/2+1)~ASz.

Figure 8:
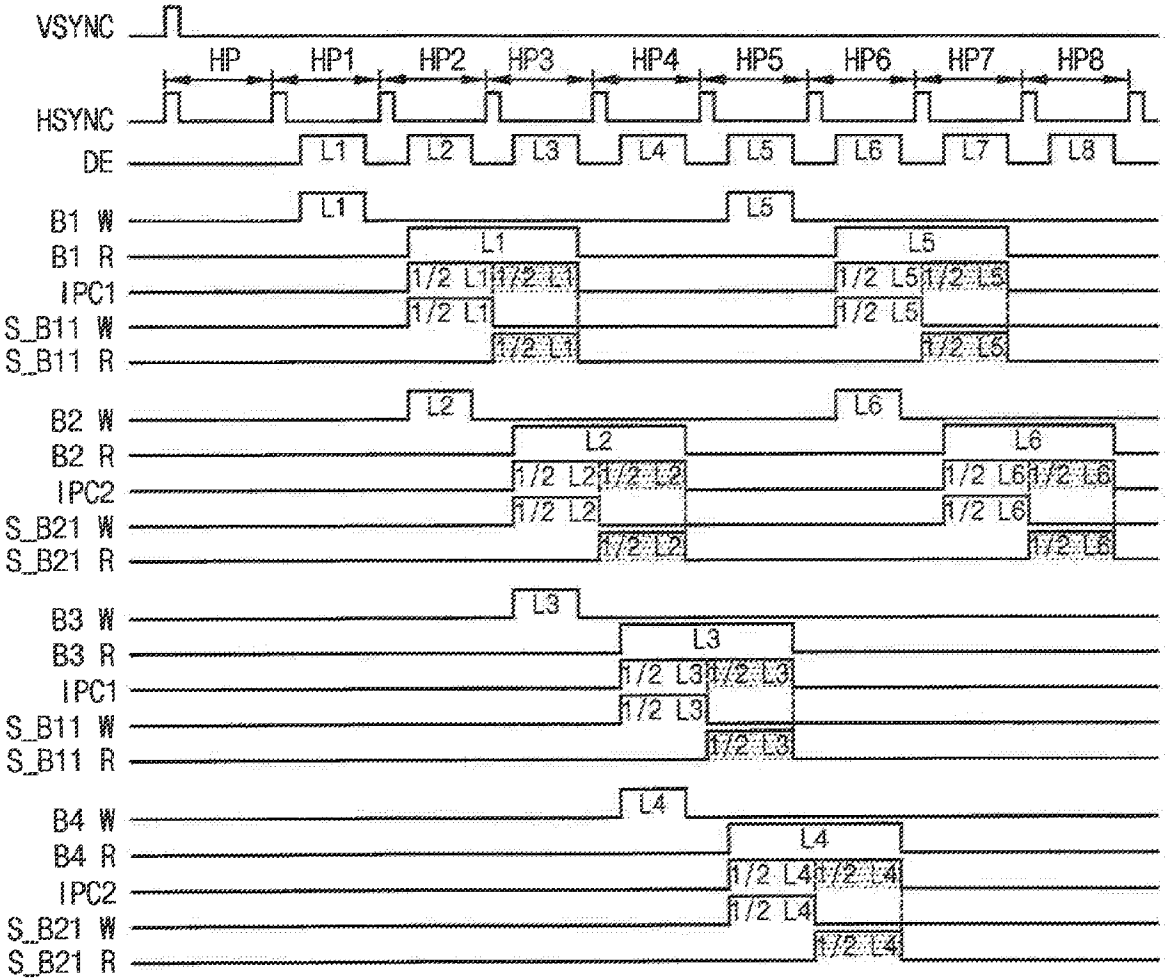
FIG. 8 is a timing diagram for describing an operation of the display driving circuit of FIG. 7, according to an exemplary embodiment of the inventive concept.

FIG. 8 is a timing diagram for describing an operation of the display driving circuit **10*c* of FIG. 7**, according to an exemplary embodiment of the inventive concept.

In FIG. 8, areas with dash lines represent periods during which the processed data D_PRO are provided from the first and second image processing units 300-1 and 300-2 to the source driver 400.

Referring to FIGS. 7 and 8, the serial communication unit 700 may receive the image signals IS and the control signals CONS from an external device through a serial interface, and generate the pixel data D_PI corresponding to one row during each horizontal period HP. The serial communication unit 700 may provide the pixel data D_PI corresponding to one row to the buffer controller 100 during each horizontal period HP. The serial communication unit 700 may generate the vertical synchronization signal VSYNC, the horizontal synchronization signal HSYNC and the data enable signal DE based on the control signals CONS, and provide the vertical synchronization signal VSYNC, the horizontal synchronization signal HSYNC and the data enable signal DE to the timing controller 500.

As illustrated in FIG. 8, the data enable signal DE may be activated at each horizontal period HP, and the buffer controller 100 may receive the pixel data D_PI corresponding to one row while the data enable signal DE is activated.

The buffer controller 100 may receive the pixel data D_PI corresponding to a first row L1 during a first horizontal period HP1, and store the pixel data D_PI in the first buffer B1 200-1 (B1 W).

The image processing circuit IPC1 310-1 may read the pixel data D_PI stored in the first buffer B1 200-1 during a second horizontal period HP2 and a third horizontal period HP3 (B1 R), and perform a signal processing on the read pixel data D_PI to generate the processed data D_PRO.

The delay controller 320-1 may store the processed data D_PRO, which correspond to ½ of the first row (½ L1) generated by the image processing circuit IPC1 310-1 during the second horizontal period HP2, in the first sub buffer S_B11 331 (S_B11 W).

The delay controller 320-1 may provide the processed data D_PRO stored in the first sub buffer S_B11 331 to the first shift register 410-1 during the third horizontal period HP3 (S_B11 R), and provide the processed data D_PRO, which correspond to ½ of the first row (½ L1) generated by the image processing circuit IPC1 310-1 during the third horizontal period HP3, to the second shift register 410-2 during the third horizontal period HP3.

The buffer controller 100 may receive the pixel data D_PI corresponding to a second row L2 during the second horizontal period HP2, and store the pixel data D_PI in the second buffer B2 200-2 (B2 W).

The image processing circuit IPC2 310-2 may read the pixel data D_PI stored in the second buffer B2 200-2 during the third horizontal period HP3 and a fourth horizontal period HP4 (B2 R), and perform a signal processing on the read pixel data D_PI to generate the processed data D_PRO.

The delay controller 320-2 may store the processed data D_PRO, which correspond to ½ of the second row (½ L2) generated by the image processing circuit IPC2 310-2 during the third horizontal period HP3, in the first sub buffer S_B21 332 (S_B21 W).

The delay controller 320-2 may provide the processed data D_PRO stored in the first sub buffer S_B21 332 to the first shift register 410-1 during the fourth horizontal period HP4 (S_B21 R), and provide the processed data D_PRO, which correspond to ½ of the second row (½ L2) generated by the image processing circuit IPC2 310-2 during the fourth horizontal period HP4, to the second shift register 410-2 during the fourth horizontal period HP4.

The buffer controller 100 may receive the pixel data D_PI corresponding to a third row L3 during the third horizontal period HP3, and store the pixel data D_PI in the third buffer B3 200-3 (B3 W).

The image processing circuit IPC1 310-1 may read the pixel data D_PI stored in the third buffer B3 200-3 during the fourth horizontal period HP4 and a fifth horizontal period HP5 (B3 R), and perform a signal processing on the read pixel data D_PI to generate the processed data D_PRO.

The delay controller 320-1 may store the processed data D_PRO, which correspond to ½ of the third row (½ L3) generated by the image processing circuit IPC1 310-1 during the fourth horizontal period HP4, in the first sub buffer S_B111 331 (S_B11 W).

The delay controller 320-1 may provide the processed data D_PRO stored in the first sub buffer S_B11 331 to the first shift register 410-1 during the fifth horizontal period HP5 (S_B11 R), and provide the processed data D_PRO, which correspond to ½ of the third row (½ L3) generated by the image processing circuit IPC1 310-1 during the fifth horizontal period HP5, to the second shift register 410-2 during the fifth horizontal period HP5.

The buffer controller 100 may receive the pixel data D_PI corresponding to a fourth row L4 during the fourth horizontal period HP4, and store the pixel data D_PI in the fourth buffer B4 200-4 (B4 W).

The image processing circuit IPC2 310-2 may read the pixel data D_PI stored in the fourth buffer B4 200-4 during the fifth horizontal period HP5 and a sixth horizontal period HP6 (B4 R), and perform a signal processing on the read pixel data D_PI to generate the processed data D_PRO.

The delay controller 320-2 may store the processed data D_PRO, which correspond to ½ of the fourth row (½ L4) generated by the image processing circuit IPC2 310-2 during the fifth horizontal period HP5, in the first sub buffer S_B21 332 (S_B21 W).

The delay controller 320-2 may provide the processed data D_PRO stored in the first sub buffer S_B21 332 to the first shift register 410-1 during the sixth horizontal period HP6 (S_B21 R), and provide the processed data D_PRO, which correspond to ½ of the fourth row (½ LA) generated by the image processing circuit IPC2 310-2 during the sixth horizontal period HP6, to the second shift register 410-2 during the sixth horizontal period HP6.

As described above, the first and second image processing circuits 310-1 and 310-2 may perform a signal processing on the pixel data D_PI, which are stored in their corresponding buffers during the horizontal period HP, during two of the horizontal periods to generate the processed data D_PRO, and provide the processed data D_PRO to the source driver 400 in an interleaving scheme. Therefore, the source driver 400 may receive the processed data D_PRO corresponding to one row from the first and second image processing circuits 310-1 and 310-2 during each horizontal period HP.

The first and second shift registers 410-1 and 410-2, the first and second latch units 420-1 and 420-2, and the first and second conversion units 430-1 and 430-2 may perform an operation described above with reference to FIG. 6 to generate the analog signals AS1~ASz corresponding to one row during each horizontal period HP.

Figure 9:
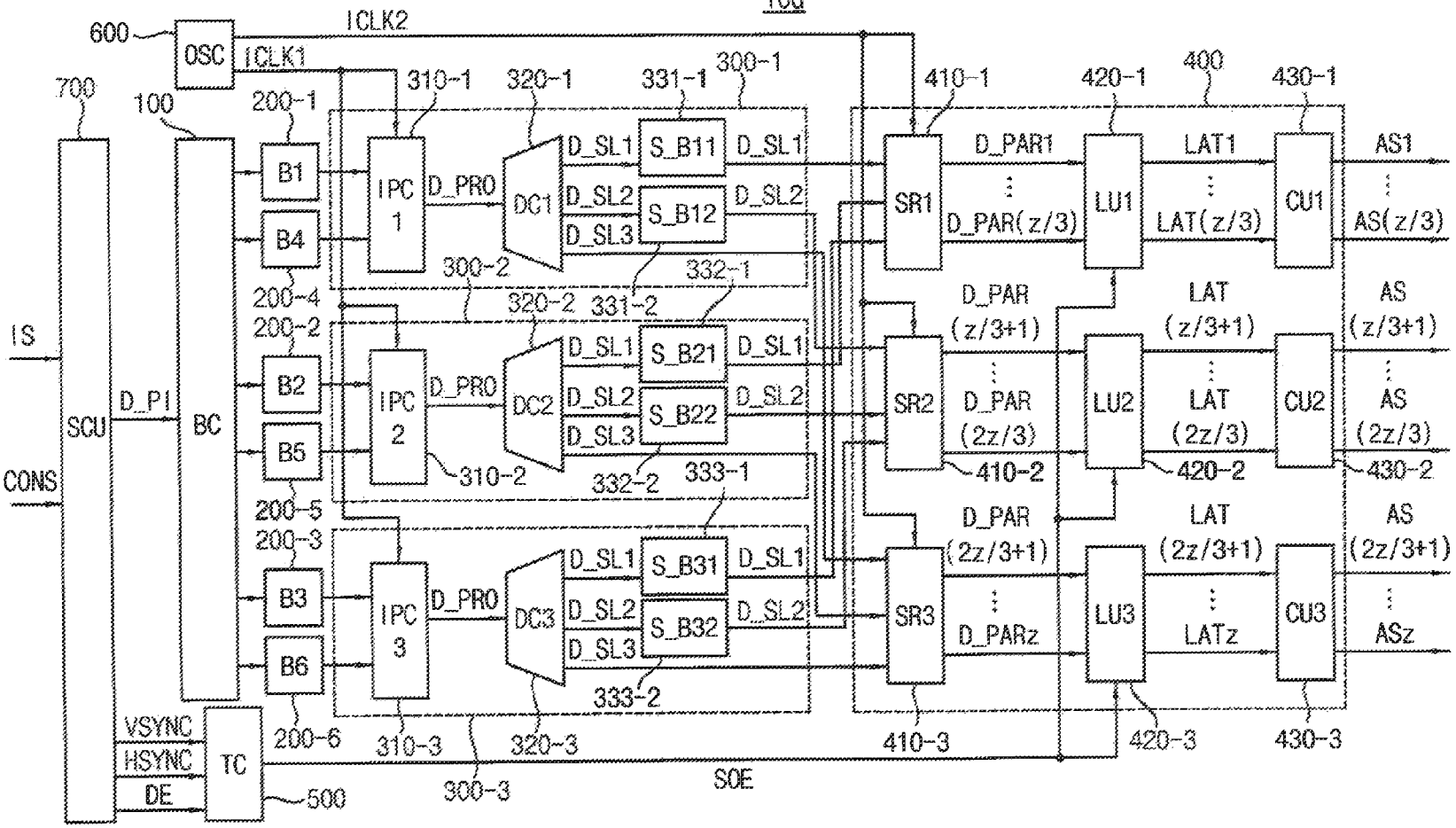
FIG. 9 is a block diagram illustrating a display driving circuit according to an exemplary embodiment of the inventive concept.

FIG. 9 is a block diagram illustrating a display driving circuit according to an exemplary embodiment of the inventive concept.

A display driving circuit 10*d* of FIG. 9 may correspond to the display driving circuit 10*b* of FIG. 3 when n is three.

Referring to FIG. 9, the display driving circuit 10*d* may include the buffer controller BC 100, the first through sixth buffers B1, B2, B3, B4, B5 and B6 200-1, 200-2, 200-3, 200-4, 200-5 and 200-6, the first through third image processing units 300-1, 300-2 and 300-3, the source driver 400, the timing controller TC 500, the oscillator OSC 600 and the serial communication unit SCU 700.

The first image processing unit 300-1 may include an image processing circuit IPC1 310-1, a delay controller DC1 320-1 and first and second sub buffers S_B11 and S_B12 331-1 and 331-2. The image processing circuit IPC1 310-1 may output the processed data D_PRO, the delay controller DC1 320-1 may output sub line data D_SL1, D_SL2 and D_SL3, the first sub buffer S_B11 331-1 may output the sub line data D_SL1 and the second sub buffer S_B12 331-2 may output the sub line data D_SL2.

The second image processing unit 300-2 may include an image processing circuit IPC2 310-2, a delay controller DC2 320-2 and first and second sub buffers S_B21 and S_B22 332-1 and 332-2. The image processing circuit IPC2 310-2 may output the processed data D_PRO, the delay controller DC2 320-2 may output the sub line data D_SL1, D_SL2 and D_SL3, the first sub buffer S_B21 332-1 may output the sub line data D_SL1 and the second sub buffer S_B32 332-2 may output the sub line data D_SL2.

The third image processing unit 300-3 may include an image processing circuit IPC3 310-3, a delay controller DC3 320-3 and first and second sub buffers S_B31 and S_B32 333-1 and 333-2. The image processing circuit IPC1 310-3 may output the processed data D_PRO, the delay controller DC3 320-3 may output the sub line data D_SL1, D_SL2 and D_SL3, the first sub buffer S_B31 333-1 may output the sub line data D_SL1 and the second sub buffer S_B32 333-2 may output the sub line data D_SL2.

The source driver 400 may include first through third shift registers SR1, SR2 and SR3 410-1, 410-2 and 410-3, first through third latch units LU1, LU2 and LU3 420-1, 420-2 and 420-3, and first through third conversion units CU1, CU2 and CU3 430-1, 430-2 and 430-3. The first shift register SR1 410-1 may output parallel data D_PAR1~D_PAR(z/3), the first latch unit LU1 420-1 may output latch signals LAT1~LAT(z/3), and the first conversion unit CU1 430-1 may output analog signals AS1~AS(z/3). The second shift register SR2 410-2 may output parallel data D_PAR(z/3+1)~D_PAR(2z/3), the second latch unit LU2 420-2 may output latch signals LAT(z/3+1)~LAT(2z/3), and the second conversion unit CU2 430-2 may output analog signals AS(z/3+1)~AS(2z/3). The third shift register SR3 410-3 may output parallel data D_PAR(2z/3+1)~D_PARz, the third latch unit LU3 420-3 may output latch signals LAT(2z/3+1)~LATz, and the third conversion unit CU3 430-3 may output analog signals AS(2z/3+1)~ASz.

Figure 10:
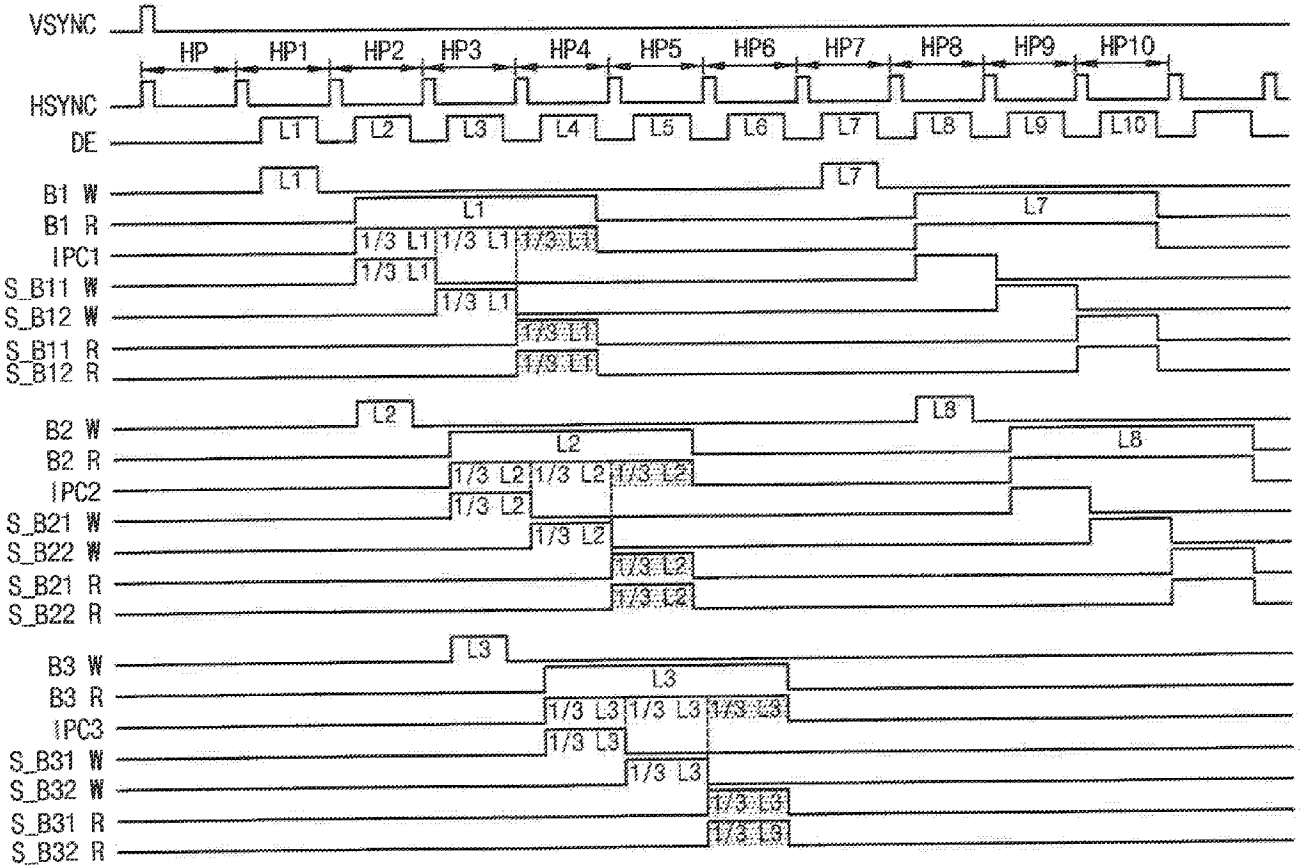
FIG. 10 is a timing diagram for describing an operation of the display driving circuit of FIG. 9, according to an exemplary embodiment of the inventive concept.

FIG. 10 is a timing diagram for describing an operation of the display driving circuit 10*d* of FIG. 9, according to an exemplary embodiment of the inventive concept.

In FIG. 10, areas with dash lines represent periods during which the processed data D_PRO are provided from the first through third image processing units 300-1, 300-2 and 300-3 to the source driver 400.

Referring to FIGS. 9 and 10, the serial communication unit 700 may receive the image signals IS and the control signals CONS from an external device through a serial interface, and generate the pixel data D_PI corresponding to one row during each horizontal period HP. The serial communication unit 700 may provide the pixel data D_PI corresponding to one row to the buffer controller 100 during each horizontal period HP. The serial communication unit 700 may generate the vertical synchronization signal VSYNC, the horizontal synchronization signal HSYNC and the data enable signal DE based on the control signals CONS, and provide the vertical synchronization signal VSYNC, the horizontal synchronization signal HSYNC and the data enable signal DE to the timing controller 500.

As illustrated in FIG. 10, the data enable signal DE may be activated at each horizontal period HP, and the buffer controller 100 may receive the pixel data D_PI corresponding to one row while the data enable signal DE is activated.

The buffer controller 100 may receive the pixel data D_PI corresponding to a first row L1 during a first horizontal period HP1, and store the pixel data D_PI in the first buffer B1 200-1 (B1 W).

The image processing circuit IPC1 310-1 may read the pixel data D_PI stored in the first buffer B1 200-1 during a second horizontal period HP2, a third horizontal period HP3 and a fourth horizontal period HP4 (B1 R), and perform a signal processing on the read pixel data D_PI to generate the processed data D_PRO.

The delay controller 320-1 may store the processed data D_PRO, which correspond to ⅓ of the first row (⅓ L1) generated by the image processing circuit IPC1 310-1 during the second horizontal period HP2, in the first sub buffer S_B11 331-1 (S_B11 W).

The delay controller 320-1 may store the processed data D_PRO, which correspond to ⅓ of the first row (⅓ L1) generated by the image processing circuit IPC1 310-1 during the third horizontal period HP3, in the second sub buffer S_B12 331-2 (S_B12 W).

The delay controller 320-1 may provide the processed data D_PRO stored in the first sub buffer S_B11 331-1 to the first shift register 410-1 during the fourth horizontal period HP4 (S_B11 R), provide the processed data D_PRO stored in the second sub buffer S_B12 331-2 to the second shift register 410-2 during the fourth horizontal period HP4 (S_B12 R), and provide the processed data D_PRO, which correspond to ⅓ of the first row (⅓ L1) generated by the image processing circuit IPC1 310-1 during the fourth horizontal period HP4, to the third shift register 410-3 during the fourth horizontal period HP4.

The buffer controller 100 may receive the pixel data D_PI corresponding to a second row L2 during the second horizontal period HP2, and store the pixel data D_PI in the second buffer B2 200-2 (B2 W).

The image processing circuit IPC2 310-2 may read the pixel data D_PI stored in the second buffer B2 200-2 during the third horizontal period HP3, the fourth horizontal period HP4 and a fifth horizontal period HP5 (B2 R), and perform a signal processing on the read pixel data D_PI to generate the processed data D_PRO.

The delay controller 320-2 may store the processed data D_PRO, which correspond to ⅓ of the second row (⅓ L2) generated by the image processing circuit IPC2 310-2 during the third horizontal period HP3, in the first sub buffer S_B21 332-1 (S_B21 W).

The delay controller 320-2 may store the processed data D_PRO, which correspond to ⅓ of the second row (⅓ L2) generated by the image processing circuit IPC2 310-2 during the fourth horizontal period HP4, in the second sub buffer S_B22 332-2 (S_B22 W).

The delay controller 320-2 may provide the processed data D_PRO stored in the first sub buffer S_B21 332-1 to the first shift register 410-1 during the fifth horizontal period HP5 (S_B21 R), provide the processed data D_PRO stored in the second sub buffer S_B22 332-2 to the second shift register 410-2 during the fifth horizontal period HP5 (S_B22 R), and provide the processed data D_PRO, which correspond to ⅓ of the second row (⅓ L2) generated by the image processing circuit IPC2 310-2 during the fifth horizontal period HP5, to the third shift register 410-3 during the fifth horizontal period HP5.

The buffer controller 100 may receive the pixel data D_PI corresponding to a third row L3 during the third horizontal period HP3, and store the pixel data D_PI in the third buffer B3 200-3 (B3 W).

The image processing circuit IPC3 310-3 may read the pixel data D_PI stored in the third buffer B3 200-3 during the fourth horizontal period HP4, the fifth horizontal period HP5 and a sixth horizontal period HP6 (B3 R), and perform a signal processing on the read pixel data D_PI to generate the processed data D_PRO.

The delay controller 320-3 may store the processed data D_PRO, which correspond to ⅓ of the third row (⅓ L3) generated by the image processing circuit IPC3 310-3 during the fourth horizontal period HP4, in the first sub buffer S_B31 333-1 (S_B31 W).

The delay controller 320-3 may store the processed data D_PRO, which correspond to ⅓ of the third row (⅓ L3) generated by the image processing circuit IPC3 310-3 during the fifth horizontal period HP5, in the second sub buffer S_B32 333-2 (S_B32 W).

The delay controller 320-3 may provide the processed data D_PRO stored in the first sub buffer S_B31 333-1 to the first shift register 410-1 during the sixth horizontal period HP6 (S_B31 R), provide the processed data D_PRO stored in the second sub buffer S_B32 333-2 to the second shift register 410-2 during the sixth horizontal period HP6 (S_B32 R), and provide the processed data D_PRO, which correspond to ⅓ of the third row (⅓ L3) generated by the image processing circuit IPC3 310-3 during the sixth horizontal period HP6, to the third shift register 410-3 during the sixth horizontal period HP6.

As described above, the first through third image processing circuits 310-1, 310-2 and 310-3 may perform a signal processing on the pixel data D_PI, which are stored in their corresponding buffers during the horizontal period HP, during three of the horizontal periods to generate the processed data D_PRO, and provide the processed data D_PRO to the source driver 400 in an interleaving scheme. Therefore, the source driver 400 may receive the processed data D_PRO corresponding to one row from the first through third image processing circuits 310-1, 310-2 and 310-3 during each horizontal period HP.

The first through third shift registers 410-1, 410-2 and 410-3, the first through third latch units 420-1, 420-2 and 420-3, and the first through third conversion units 430-1, 430-2 and 430-3 may perform an operation described above with reference to FIG. 6 to generate the analog signals AS1~ASz corresponding to one row during each horizontal period HP.

Hereinbefore, the first time interval is described to be equal to the horizontal period, which corresponds to a period of the horizontal synchronization signal HSYNC. However, according to an exemplary embodiment of the inventive concept, the first time interval may correspond to 1/m times of the horizontal period. Here, m represents an integer equal to or greater than two. In this case, the size of each of the first through (2*n)-th buffers 200-1~200-2*n* may be equal to a total size of the pixel data D_PI corresponding to 1/m row. Therefore, as m increases, a total size of buffers included in the display driving circuit 10 may decrease such that a size of the display driving circuit 10 may decrease.

Figure 11:
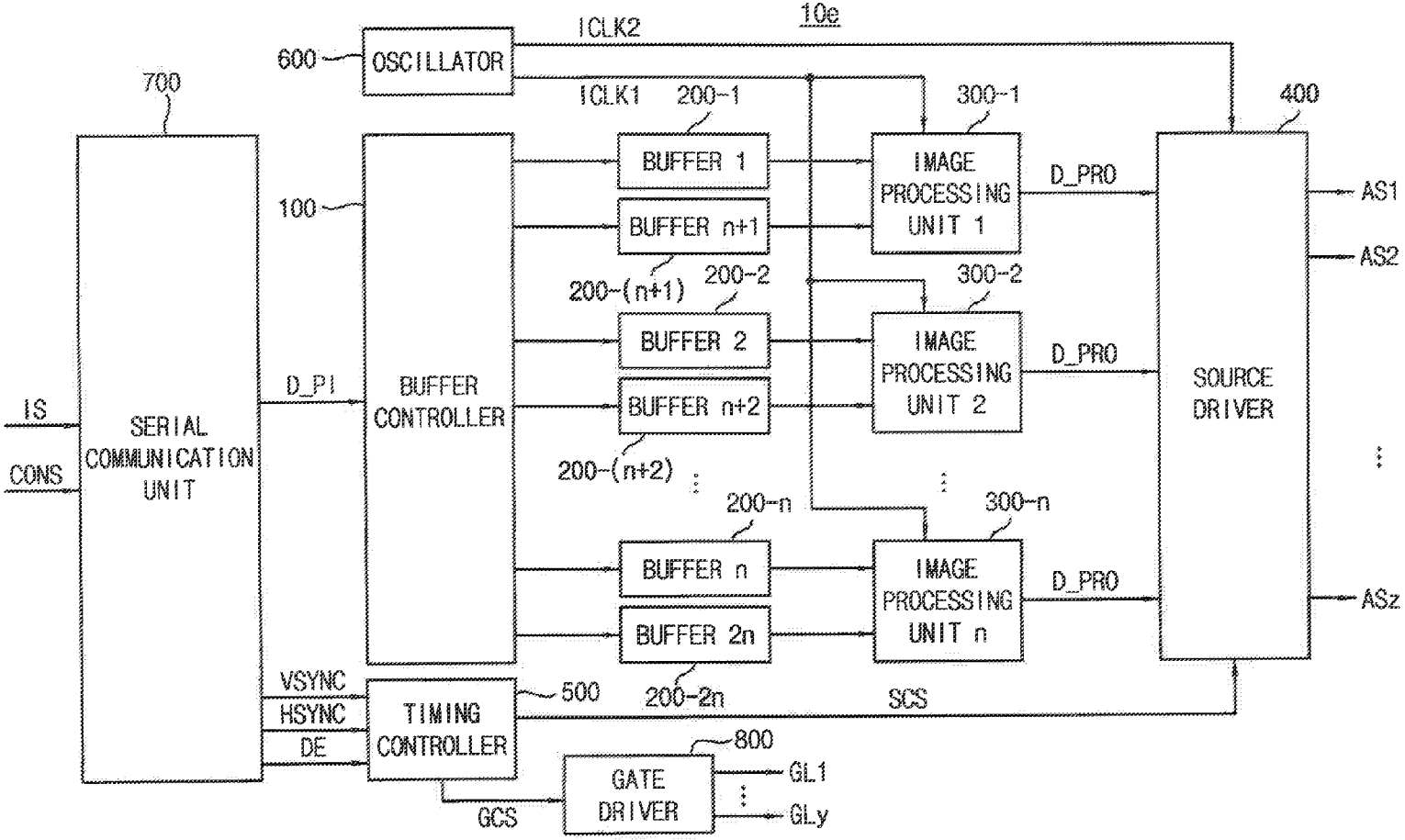
FIG. 11 is a block diagram illustrating a display driving circuit according to an exemplary embodiment of the inventive concept.

FIG. 11 is a block diagram illustrating a display driving circuit according to an exemplary embodiment of the inventive concept.

Referring to FIG. 11, a display driving circuit 10*e* may include the buffer controller 100, the first through (2*n)-th buffers 200-1~200-2*n*, the first through n-th image processing units 300-1~300-*n*, the source driver 400, the timing controller 500, the oscillator 600, the serial communication unit 700 and a gate driver 800.

The display driving circuit 10*e* of FIG. 11 may be the same as the display driving circuit 10*b* of FIG. 3 except that the display driving circuit 10*e* of FIG. 11 further includes the gate driver 800.

The timing controller 500 may receive the vertical synchronization signal VSYNC, the horizontal synchronization signal HSYNC and the data enable signal DE. The timing controller 500 may generate a gate control signal GCS to control the gate driver 800 based on the vertical synchronization signal VSYNC, the horizontal synchronization signal HSYNC and the data enable signal DE. The gate driver 800 may be coupled to a plurality of gate lines GL1~GLy. Here, y represents a positive integer. The gate driver 800 may successively select one of the plurality of gate lines GL1~GLy at each horizontal period HP based on the gate control signal GCS.

As described above with reference to FIGS. 1 to 11, in the display driving circuit 10 according to an exemplary embodiment of the inventive concept, although the pixel data D_PI are provided to the display driving circuit 10 in a relatively high frequency, each of the first through n-th image processing units 300-1~300-*n* may operate in synchronization with the first internal clock signal ICLK1 having the first frequency, which is a relatively low frequency, and the source driver 400 may operate in synchronization with the second internal clock signal ICLK2 having the second frequency, which is a half of the first frequency. Therefore, the display driving circuit 10 may prevent EMI and decrease power consumption.

Figure 12:
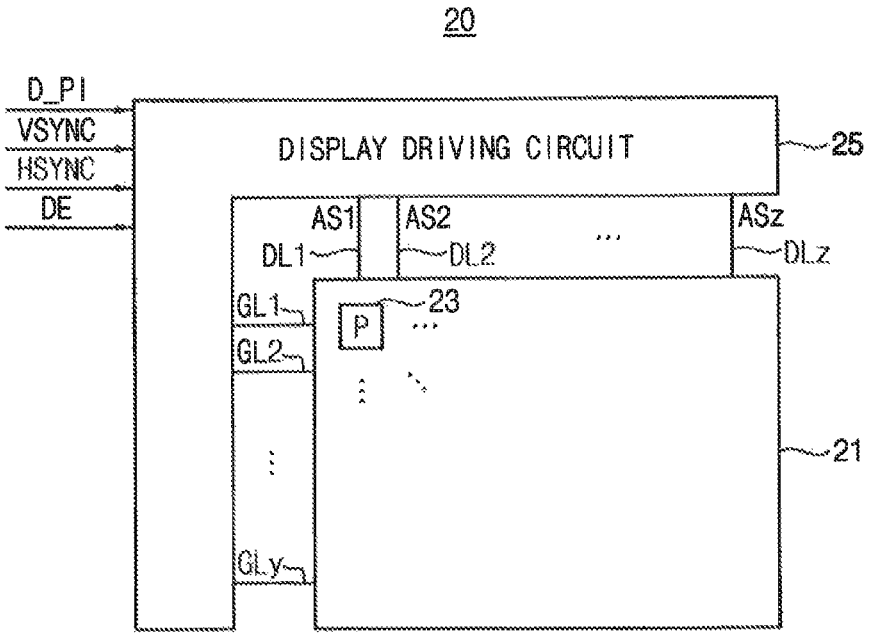
FIG. 12 is a block diagram illustrating a display device according to an exemplary embodiment of the inventive concept.

FIG. 12 is a block diagram illustrating a display device according to an exemplary embodiment of the inventive concept.

Referring to FIG. 12, a display device 20 includes a display panel 21 and a display driving circuit 25.

The display panel 21 includes a plurality of pixels P 23 coupled to a plurality of gate lines GL1~GLy and a plurality of data lines DL1~DLz.

The display driving circuit 25 successively selects one of the plurality of gate lines GL1~GLy at each horizontal period, and provides analog signals AS1~ASz to the pixels 23 coupled to the selected gate line through the plurality of data lines DL1~DLz during the horizontal period.

The display driving circuit 25 receives a vertical synchronization signal VSYNC, a horizontal synchronization signal HSYNC, a data enable signal DE and pixel data D_PI, buffers the pixel data D_PI received during a first time interval, which is equal to or smaller than the horizontal period, and processes the buffered pixel data D_PI to generate the analog signals AS1~ASz during n times of the first time interval.

In an exemplary embodiment of the inventive concept, the display driving circuit 25 included in the display device 20 may be implemented with the display driving circuit 10 of FIG. 1. A structure and an operation of the display driving circuit 10 of FIG. 1 and its variants are described above with reference to FIGS. 1 to 11. Therefore, a detailed description of the display driving circuit 25 of FIG. 12 will be omitted.

Figure 13:
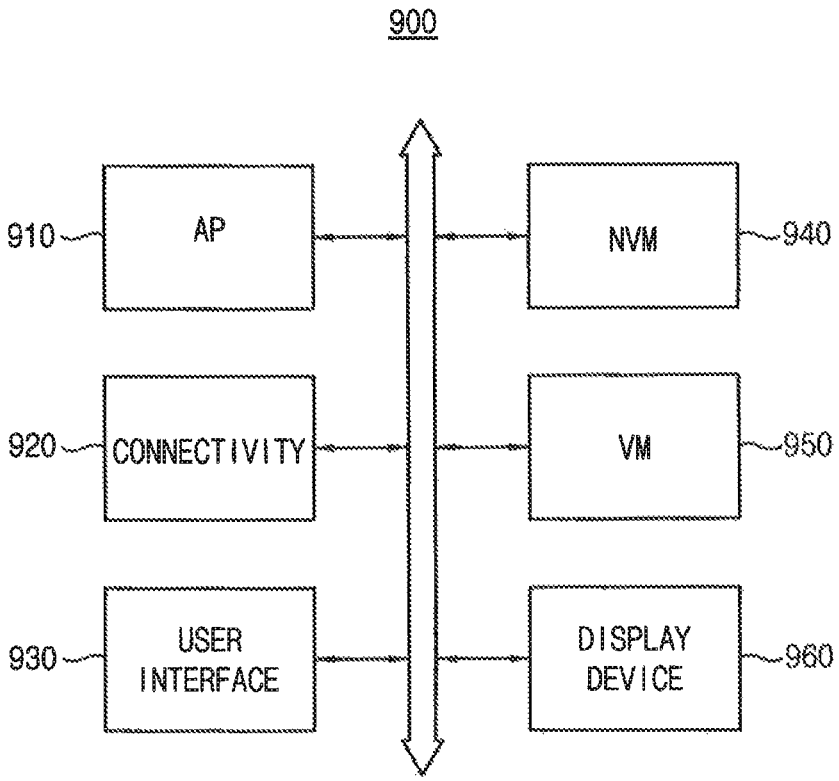
FIG. 13 is a block diagram illustrating a mobile system according to an exemplary embodiment of the inventive concept.

FIG. 13 is a block diagram illustrating a mobile system according to an exemplary embodiment of the inventive concept.

Referring to FIG. 13, a mobile system 900 includes an application processor AP 910, a connectivity unit 920, a user interface 930, a nonvolatile memory device NVM 940, a volatile memory device VM 950 and a display device 960. In an exemplary embodiment of the inventive concept, the mobile system 900 may be a mobile phone, a smart phone, a personal digital assistant (PDA), a portable multimedia player (PMP), a digital camera, a music player, a portable game console, a navigation system, etc.

The application processor 910 may execute applications, such as a web browser, a game application, a video player, etc. In an exemplary embodiment of the inventive concept, the application processor 910 may include a single core or multiple cores. For example, the application processor 910 may be a multi-core processor, such as a dual-core processor, a quad-core processor, a hexa-core processor, etc. The application processor 910 may include an internal or external cache memory.

The connectivity unit 920 may perform wired or wireless communication with an external device. For example, the connectivity unit 920 may perform Ethernet communication, near field communication (NFC), radio frequency identification (RFID) communication, mobile telecommunication, memory card communication, universal serial bus (USB) communication, etc. In an exemplary embodiment of the inventive concept, the connectivity unit 920 may include a baseband chipset that supports communications, such as global system for mobile communications (GSM), general packet radio service (GPRS), wideband code division multiple access (WCDMA), high speed downlink/uplink packet access (HSxPA), etc.

The volatile memory device 950 may store data processed by the application processor 910, or may operate as a working memory.

The nonvolatile memory device 940 may store a boot image for booting the mobile system 900. For example, the nonvolatile memory device 940 may be an electrically erasable programmable read-only memory (EEPROM), a flash memory, a phase change random access memory (PRAM), a resistance random access memory (RRAM), a nano floating gate memory (NFGM), a polymer random access memory (PoRAM), a magnetic random access memory (MRAM), a ferroelectric random access memory (FRAM), etc.

The user interface 930 may include at least one input device, such as a keypad, a touch screen, etc., and at least one output device, such as a speaker, a printer, etc.

The display device 960 may display image signals provided from the application processor 910. The application processor 910 may transmit the image signals to the display device 960 in synchronization with a clock signal having a relatively high frequency through a high speed serial interface (HSSI) such as a MIPI. The display device 960 may process the image signals in synchronization with an internal clock signal having a relatively low frequency to display the image signals.

The display device 960 may be embodied with the display device 20 of FIG. 12. A structure and an operation of components of the display device 20 of FIG. 12 and their variants are described above with reference to FIGS. 1 to 12. Therefore, a detailed description of the display device 960 will be omitted.

In an exemplary embodiment of the inventive concept, the mobile system 900 may further include an image processor, and/or a storage device, such as a memory card, a solid state drive (SSD), a hard disk drive (HDD), a compact disk read only memory (CD-ROM), etc.

In an exemplary embodiment of the inventive concept, the mobile system 900 and/or components of the mobile system 900 may be packaged in various forms, such as package on package (PoP), ball grid arrays (BGAs), chip scale packages (CSPs), plastic leaded chip carrier (PLCC), plastic dual in-line package (PDIP), die in waffle pack, die in wafer form, chip on board (COB), ceramic dual in-line package (CERDIP), plastic metric quad flat pack (MQFP), thin quad flat pack (TQFP), small outline integrated circuit (SOIC), shrink small outline package (SSOP), thin small outline package (TSOP), system in package (SIP), multi chip package (MCP), wafer-level fabricated package (WFP), or wafer-level processed stack package (WSP).

Figure 14:
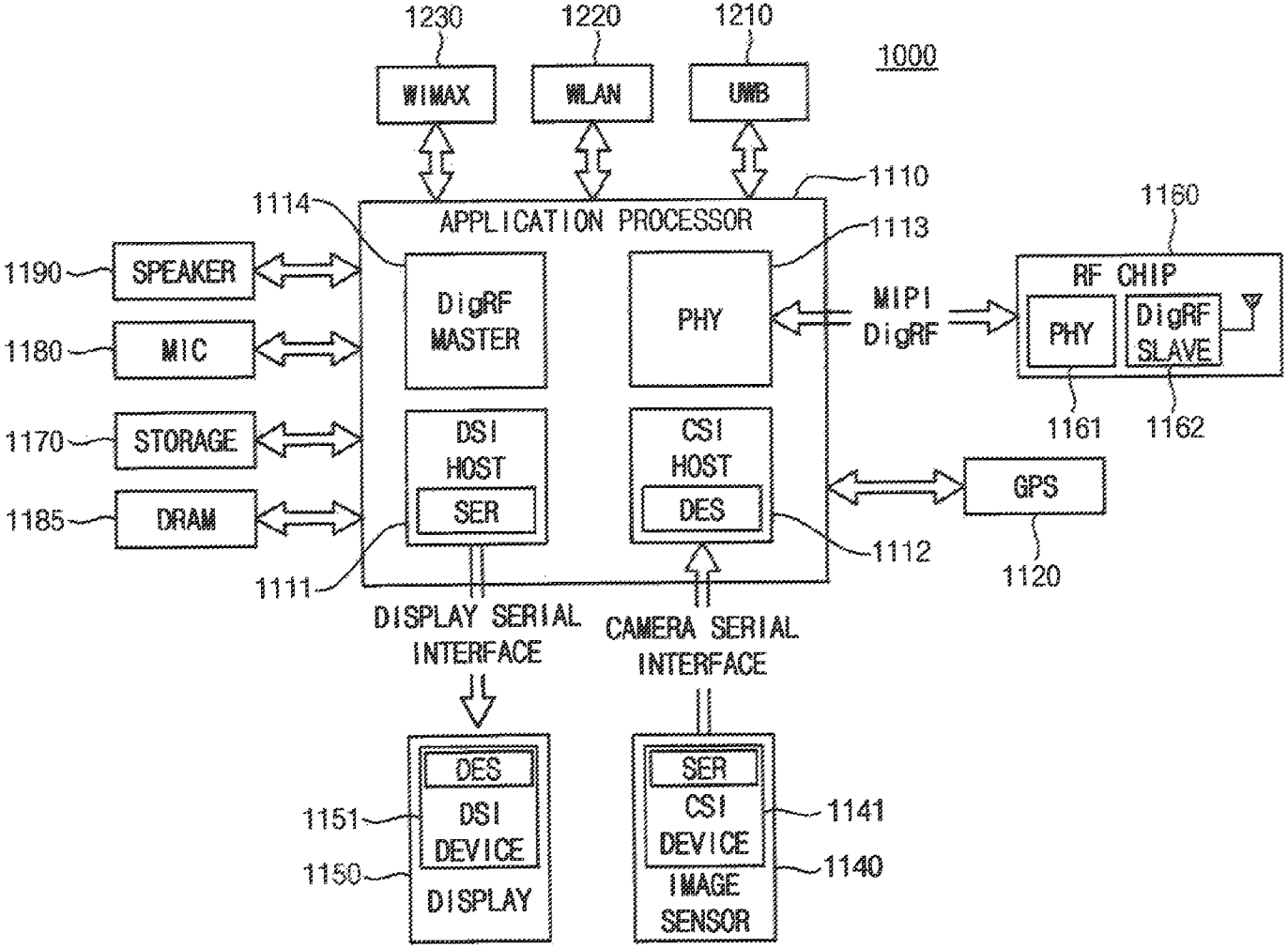
FIG. 14 is a block diagram illustrating an exemplary embodiment of an interface used in a mobile system of FIG. 13.

FIG. 14 is a block diagram illustrating an exemplary embodiment of an interface used in a mobile system of FIG. 13.

Referring to FIG. 14, a mobile system 1000 may be implemented by a data processing device (e.g., a cellular phone, a PDA, a PMP, a smart phone, etc.) that uses or supports a MIPI. The mobile system 1000 may include an application processor 1110, an image sensor 1140, a display device 1150, etc.

A CSI host 1112 of the application processor 1110 may perform a serial communication with a CSI device 1141 of the image sensor 1140 via a camera serial interface (CSI). In an exemplary embodiment of the inventive concept, the CSI host 1112 may include a deserializer (DES), and the CSI device 1141 may include a serializer (SER). A DSI host 1111 of the application processor 1110 may perform a serial communication with a DSI device 1151 of the display device 1150 via a display serial interface (DSI). In an exemplary embodiment of the inventive concept, the DSI host 1111 may include a serializer (SER), and the DSI device 1151 may include a deserializer (DES).

The mobile system 1000 may further include a radio frequency (RF) chip 1160 for performing a communication with the application processor 1110. A physical layer (PHY) 1113 of the mobile system 1000 and a physical layer (PHY) 1161 of the RF chip 1160 may perform data communications based on a MIPI DigRF. The application processor 1110 may further include a DigRF MASTER 1114 that controls the data communications according to the MIPI DigRF of the PHY 1161, and the RF chip 1160 may further include a DigRF SLAVE 1162 controlled by the DigRF MASTER 1114.

The mobile system 1000 may further include a global positioning system (GPS) 1120, a storage 1170, a microphone (MIC) 1180, a dynamic random access memory (DRAM) device 1185, and a speaker 1190. In addition, the mobile system 1000 may perform communications using an ultra wideband (UWB) technique 1210, a wireless local area network (WLAN) 1220, a worldwide interoperability for microwave access (WIMAX) technique 1230, etc. However, the structure and the interface of the mobile system 1000 are not limited thereto.

While the inventive concept has been particularly shown and described with reference to exemplary embodiments thereof, it will be apparent to those of ordinary skill in the art that various changes in form and detail may be made therein without departing from the spirit and scope of the inventive concept as defined by the following claims.

What is claimed is:

1. A display driving circuit, comprising:

first through (2*n)-th buffers, n being an integer equal to or greater than two;

a buffer controller configured to circularly select one of the first through (2*n)-th buffers in an order from the first buffer to the (2*n)-th buffer at each of a plurality of first time intervals, and configured to store pixel data received during the first time interval in the selected buffer;

first through n-th image processing units, each of the first through n-th image processing units being coupled to two corresponding buffers among the first through (2*n)-th buffers, each of the first through n-th image processing units configured to process the pixel data, which are stored in at least one of their corresponding buffers, during each of n of the first time intervals to generate processed data when the pixel data are stored in the corresponding buffer during the first time interval; and a source driver configured to generate analog signals based on the processed data received from the first through n-th image processing units.

2. The display driving circuit of claim 1, wherein a k-th image processing unit is coupled to a k-th buffer and an (n+k)-th buffer, where k is a positive integer equal to or smaller than n.

3. The display driving circuit of claim 1, wherein each of the first through n-th image processing units delays at least a part of the processed data, which are generated during n of the first time intervals, and then provides the delayed processed data to the source driver.

4. The display driving circuit of claim 1, further comprising:

an oscillator configured to generate a first internal clock signal having a first frequency and a second internal clock signal having a second frequency, the first frequency being smaller than 1/(2*n) of a frequency in which the pixel data are provided to the buffer controller, the second frequency corresponding to a half of the first frequency, wherein each of the first through n-th image processing units operates in synchronization with the first internal clock signal, and wherein the source driver operates in synchronization with the second internal clock signal.

5. The display driving circuit of claim 4, wherein each of the first through n-th image processing units reads the pixel data from the corresponding buffer in a unit of two pixels in synchronization with the first internal clock signal, processes the read pixel data, and generates the processed data in a unit of two pixels.

6. The display driving circuit of claim 1, further comprising:

a serial communication unit configured to receive image signals corresponding to one row of a display panel from an external device through a serial interface during a horizontal period, which corresponds to a period of a horizontal synchronization signal, and generate the pixel data corresponding to the one row during the horizontal period.

7. The display driving circuit of claim 6, wherein the serial interface includes a mobile industry processor interface (MIPI).

8. The display driving circuit of claim 1, wherein each of the first time intervals correspond to a horizontal period, which corresponds to a period of a horizontal synchronization signal.

9. The display driving circuit of claim 8, wherein one of the first through n-th image processing units provides the processed data corresponding to one row of a display panel to the source driver during one of the horizontal periods.

10. The display driving circuit of claim 8, wherein, when the pixel data corresponding to one row are stored in at least one of their corresponding buffers during the horizontal periods, each of the first through n-th image processing units temporarily stores the processed data generated during first through (n−1)-th horizontal periods, and provides the processed data generated during an n-th horizontal period together with the processed data temporarily stored during the first through (n−1)-th horizontal periods to the source driver during the n-th horizontal period.

11. The display driving circuit of claim 8, wherein each of the first through n-th image processing units includes:

first through (n−1)-th sub buffers, a size of each of the first through (n−1)-th sub buffers corresponding to 1/n of a size of each of the first through (2*n)-th buffers;

an image processing circuit configured to process 1/n of the pixel data stored in at least one of their corresponding buffers to generate the processed data corresponding to 1/n of a row of a display panel during each horizontal period from a first horizontal period to an n-th horizontal period; and a delay controller configured to store the processed data generated by the image processing circuit during each horizontal period from the first horizontal period to an (n−1)-th horizontal period in the first through (n−1)-th sub buffers as first through (n−1)-th sub line data, respectively, and output n-th sub line data, which correspond to the processed data generated by the image processing circuit during the n-th horizontal period, together with the first through (n−1)-th sub line data stored in the first through (n−1)-th sub buffers during the n-th horizontal period.

12. The display driving circuit of claim 11, wherein the source driver includes:

first through n-th shift registers configured to receive the first through n-th sub line data, respectively, from one of the first through n-th image processing units during one of the horizontal periods, and configured to output parallel data corresponding to the 1/n of a row by parallelizing the processed data corresponding to the 1/n of a row included in the first through n-th sub line data, respectively, during the horizontal period;

first through n-th latch units configured to latch the parallel data corresponding to the 1/n of a row output from the first through n-th shift registers, respectively; and first through n-th conversion units configured to generate the analog signals corresponding to the 1/n of a row based on output signals of the first through n-th latch units, respectively.

13. The display driving circuit of claim 12, wherein each of the first through n-th shift registers performs a shift operation on the processed data in a unit of four pixels to generate the parallel data.

14. The display driving circuit of claim 1, wherein the first time interval corresponds to 1/m of a horizontal period, which corresponds to a period of a horizontal synchronization signal, where m is an integer equal to or greater than two.

15. A display device, comprising:

a display panel including a plurality of pixels coupled to a plurality of gate lines and a plurality of data lines; and a display driving circuit configured to select one of the plurality of gate lines at each of a plurality of horizontal periods, and configured to provide analog signals to the pixels coupled to the selected gate line through the plurality of data lines during the horizontal periods, wherein the display driving circuit buffers pixel data received during a first time interval, which is equal to or smaller than the horizontal period, and processes the buffered pixel data to generate the analog signals during n of the first time intervals, and wherein the buffered pixel data is read in synchronization with a first internal clock having a first frequency, the first frequency being less than a frequency at which the pixel data is provided to the display driving circuit, and the analog signals are generated in synchronization with a second internal clock having a second frequency which is half of the first frequency.

16. The display device of claim 15, wherein the display driving circuit includes:

first through (2*n)-th buffers, n being an integer equal to or greater than two;

a buffer controller configured to circularly select one of the first through (2*n)-th buffers in an order from the first buffer to the (2*n)-th buffer at each of a plurality of the first time intervals, and configured to store the pixel data received during the first time interval in the selected buffer;

first through n-th image processing units, each of the first through n-th image processing units being coupled to two corresponding buffers among the first through (2*n)-th buffers, each of the first through n-th image processing units configured to process the pixel data, which are stored in at least one of their corresponding buffers, during n of the first time intervals to generate processed data when the pixel data are stored in the corresponding buffer during the first time interval; and a source driver configured to generate the analog signals based on the processed data received from the first through n-th image processing units.

17. A display driving circuit, comprising:

a first buffer configured to receive and store pixel data corresponding to a first row of a display panel in a first horizontal period;

a first image processing circuit configured to read the pixel data stored in the first buffer in a second horizontal period and a third horizontal period, and perform a signal processing on the read pixel data to generate first processed data;

a first delay controller configured to store the first processed data, which corresponds to a half of the first row, in the second horizontal period in a first sub buffer, provide the processed data stored in the first sub buffer to a first shift register in the third horizontal period, and provide the first processed data to a second shift register in the third horizontal period;

a second buffer configured to receive and store pixel data corresponding to a second row of the display panel in the second horizontal period;

a second image processing circuit configured to read the pixel data stored in the second buffer in the third horizontal period and a fourth horizontal period, and perform a signal processing on the read pixel data to generate second processed data; and a second delay controller configured to store the second processed data, which corresponds to a half of the second row, in the third horizontal period in a second sub buffer, provide the processed data stored in the second sub buffer to the first shift register in the fourth horizontal period, and provide the second processed data to the second shift register in the fourth horizontal period.

18. The display driving circuit of claim 17, wherein the first and second buffers operate in response to a first internal clock and the first and second shift registers operate in response to a second internal clock.

19. The display driving circuit of claim 18, wherein a frequency of the first internal clock is greater than a frequency of the second internal clock.

20. The display driving circuit of claim 19, wherein the first and second pixel data are provided to the display driving circuit at a frequency greater than the frequency of the first internal clock.

* * * * *